US009732752B2

(12) United States Patent
Jin et al.

(10) Patent No.: US 9,732,752 B2
(45) Date of Patent: Aug. 15, 2017

(54) SCROLL COMPRESSOR HAVING A BACK PRESSURE CHAMBER ASSEMBLY DISPOSED ON A FIXED SCROLL PLATE AND AN ELASTIC MEMBER DISPOSED BETWEEN A FLOATING PLATE AND A DISCHARGE COVER

(71) Applicant: LG ELECTRONICS INC., Seoul (KR)

(72) Inventors: Honggyun Jin, Seoul (KR); Suchul Kim, Seoul (KR); Hyunwook Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 220 days.

(21) Appl. No.: 14/703,084

(22) Filed: May 4, 2015

(65) Prior Publication Data

US 2015/0316055 A1 Nov. 5, 2015

(30) Foreign Application Priority Data

May 2, 2014 (KR) ..... 10-2014-0053655

(51) Int. Cl.
*F03C 2/00* (2006.01)
*F04C 2/00* (2006.01)
(Continued)

(52) U.S. Cl.
CPC ..... *F04C 18/0223* (2013.01); *F01C 1/0215* (2013.01); *F01C 1/0246* (2013.01);
(Continued)

(58) Field of Classification Search
CPC ..... F04C 18/0215; F04C 18/0261; F04C 18/0246; F04C 15/06; F04C 23/008;
(Continued)

(56) References Cited

U.S. PATENT DOCUMENTS 5,156,539 A * 10/1992 Anderson ..... F04C 18/0215 418/55.5
5,580,229 A * 12/1996 Beck ..... F04C 18/0215 418/57
(Continued)

FOREIGN PATENT DOCUMENTS

CN 1177062 3/1998
CN 1828022 9/2006
(Continued)

OTHER PUBLICATIONS

European Search Report dated Sep. 4, 2015.
Chinese Office Action dated Sep. 12, 2016 issued in Application No. 201510222210.X (with English translation).

*Primary Examiner* — Theresa Trieu
(74) *Attorney, Agent, or Firm* — KED & Associates, LLP

(57) ABSTRACT

A scroll compressor is provided that may include a casing including a rotational shaft, a discharge cover fixed inside of the casing to partition the inside of the casing into a suction space and a discharge space, a first scroll that is revolved by rotation of the rotational shaft, a second scroll that defines a plurality of compression chambers together with the first scroll, the second scroll having an intermediate pressure discharge hole that communicates with a compression chamber having an intermediate pressure of the plurality of compression chambers, a back pressure plate that defines a back pressure chamber that accommodates a refrigerant discharged from the intermediate pressure discharge hole, a floating plate movably disposed on or at a side of the back pressure plate to define the back pressure chamber together with the back pressure plate, and an elastic member disposed between the floating plate and the discharge cover to provide an elastic force to the floating plate.

20 Claims, 26 Drawing Sheets

(51) Int. Cl.

| | |
|---|---|
| ***F04C 18/00*** | (2006.01) |
| ***F04C 18/02*** | (2006.01) |
| ***F01C 1/02*** | (2006.01) |
| ***F04C 14/26*** | (2006.01) |
| ***F04C 23/00*** | (2006.01) |
| ***F04C 28/26*** | (2006.01) |
| ***F04C 27/00*** | (2006.01) |
| *F01C 20/26* | (2006.01) |

(52) U.S. Cl.
CPC ..... *F01C 1/0261* (2013.01); *F04C 14/26* (2013.01); *F04C 18/0215* (2013.01); *F04C 18/0246* (2013.01); *F04C 18/0261* (2013.01); *F04C 23/008* (2013.01); *F04C 27/005* (2013.01); *F04C 28/26* (2013.01); *F01C 20/26* (2013.01)

(58) Field of Classification Search
CPC .... F04C 27/005; F04C 29/122; F04C 19/124; F04C 29/126; F04C 14/26; F04C 28/26; F04C 18/0223; F01C 1/0215; F01C 1/0246; F01C 1/0261; F01C 20/24; F01C 120/26
USPC ..... 418/15, 55.1–55.6, 57, 180, 270; 417/299, 308, 310
See application file for complete search history.

(56) References Cited

U.S. PATENT DOCUMENTS

| | | | | |
|---|---|---|---|---|
| 5,803,716 | A | 9/1998 | Wallis et al. | |
| 7,988,434 | B2 * | 8/2011 | Stover ..... | F04C 18/0215 418/55.5 |
| 2006/0198748 | A1 * | 9/2006 | Grassbaugh ..... | F04C 18/0215 418/55.5 |
| 2011/0250085 | A1 * | 10/2011 | Stover ..... | F04C 18/0215 418/55.1 |

FOREIGN PATENT DOCUMENTS

| | | |
|---|---|---|
| CN | 103189654 | 7/2013 |
| JP | 9-329090 | 12/1997 |
| KR | 10-2001-0049691 | 6/2001 |
| KR | 10-1378886 | 3/2014 |

* cited by examiner

RELATED ART

SCROLL COMPRESSOR HAVING A BACK PRESSURE CHAMBER ASSEMBLY DISPOSED ON A FIXED SCROLL PLATE AND AN ELASTIC MEMBER DISPOSED BETWEEN A FLOATING PLATE AND A DISCHARGE COVER

CROSS-REFERENCE TO RELATED APPLICATION(S)

The present application claims priority under 35 U.S.C. 119 and 35 U.S.C. 365 to Korean Patent Application No. 10-2014-0053655, filed in Korea on May 2, 2014, which is hereby incorporated by reference in its entirety.

BACKGROUND

1. Field

A scroll compressor is disclosed herein.

2. Background

A scroll compressor is a compressor that includes a fixed scroll having a spiral wrap, and an orbiting scroll that revolves with respect to the fixed scroll, that is, a compressor in which the fixed scroll and the orbiting scroll are engaged with each other. The orbiting scroll revolves with respect to the fixed scroll, thereby reducing a volume of a compression chamber, which is formed between the fixed scroll and the orbiting scroll according to an orbiting motion of an orbiting scroll, thus increasing a pressure of a fluid, which is then discharged through a discharge hole formed in a central portion of the fixed scroll.

In the scroll compressor, suction, compression, and discharge of a fluid are successively performed while the orbiting scroll revolves. Accordingly, a discharge valve and a suction valve may be unnecessary in principle. Also, as a number of components of the scroll compressor is less in comparison to other types of compressors, the scroll compressor may be simplified in structure and rotate at a high speed. Also, as a variation in torque required for compression is less, and suction and compression successively occur, a relatively small amount of noise and vibration may occur.

One of important issue in the scroll compressor is leakage and lubrication between the fixed scroll and the orbiting scroll. That is, to prevent a refrigerant from leaking between the fixed scroll and the orbiting scroll, an end of the wrap has to be closely attached to a surface of a head plate to prevent the compressed refrigerant from leaking. The head plate may refer to a portion that corresponds to a main body of the fixed scroll or the orbiting scroll. That is, the head plate of the fixed scroll may be closely attached to a wrap of the orbiting scroll, and the head plate of the orbiting scroll may be closely attached to a wrap of the fixed scroll.

On the other hand, friction resistance has to be minimized so as to allow the orbiting scroll to smoothly revolve with respect to the fixed scroll. However, leakage may conflict with lubrication. That is, when the end of the wrap and the surface of the head plate are strongly attached to each other, it may be advantageous with respect to the leakage, but friction may increase, increasing damage due to noise and abrasion. On the other hand, an adhesion force is lowered, the friction may be reduced, but a sealing force may decrease, increasing the fluid leakage.

Thus, according to the related art, a back pressure chamber having an intermediate pressure, which is defined as a value between a discharge pressure and a suction pressure, may be formed in a back surface of the orbiting scroll or the fixed scroll to solve limitations with respect to sealing and friction reduction. That is, the back pressure chamber that communicates with a compression chamber having an intermediate pressure of a plurality of compression chambers formed between the orbiting scroll and the fixed scroll may be formed to allow the orbiting scroll and the fixed scroll to be adequately attached to each other, thereby solving the limitations with respect to the leakage and lubrication.

The back pressure chamber may be formed on a bottom surface of the orbiting scroll or a top surface of the fixed scroll. For convenience of description, the back pressure chamber formed on the bottom surface of the orbiting scroll and the back pressure chamber formed on the top surface of the fixed scroll are referred to as a lower back pressure type scroll compressor and an upper back pressure type scroll compressor, respectively. The lower back pressure type scroll compressor has advantages in that the lower back pressure type scroll compressor has a simple structure, and a bypass hole is easily formed. However, as the back pressure chamber is formed on the bottom surface of the orbiting scroll that performs the orbiting motion, the back pressure chamber may change in configuration and position according to the orbiting motion. As a result, the orbiting scroll may be tilted, causing vibration and noise. In addition, an O-ring inserted to prevent the refrigerant from leaking may be quickly worn out. The upper back pressure type scroll compressor has a relatively complicated structure. However, as the back pressure chamber is fixed in configuration and position, the fixed scroll may not be tilted, and sealing of the back pressure chamber may be good.

A method for processing a bearing housing and a scroll compressor including the bearing housing are disclosed in Korean Patent Publication No. 10-2001-0049691 (hereinafter, referred to as a "prior document"), published on Jun. 15, 2001, which is hereby incorporated by reference. An example of the upper back pressure type scroll compressor is disclosed in the prior document.

The scroll compressor according to the prior document includes an orbiting scroll disposed to revolve on a main frame fixedly installed inside of a casing and a fixed scroll engaged with the orbiting scroll. A back pressure chamber is defined on the fixing scroll, and a floating plate to seal the back pressure chamber is disposed to be vertically slid along an outer circumference of a discharge passage. A cover is disposed on a top surface of the floating plate to partition an inner space of the compressor into a suction space and a discharge space.

The back pressure chamber communicates with one of a plurality of compression chambers formed between the orbiting scroll and the fixed scroll having an intermediate pressure between a suction pressure and a discharge pressure, and thus, an intermediate pressure is applied to the back pressure chamber. Also, a pressure may be applied upward to the floating plate and downward to the fixed scroll. When the floating plate ascends by the pressure of the back pressure chamber, an end of the floating plate may contact the discharge cover to seal the discharge space. Also, the fixed scroll may move downward and then be closely attached to the orbiting scroll.

However, in a case of the upper back pressure type scroll compressor, when operation of the scroll compressor stops, an intermediate pressure refrigerant of the back pressure chamber may not be easily discharged toward the compression chamber and a suction-side by an orbiting scroll wrap. In detail, when the operation of the scroll compressor stops, the pressure within the scroll compressor may converge into a predetermined pressure (an equilibrium pressure). The equilibrium pressure may be a pressure slightly higher than a suction-side pressure. That is, the refrigerant of the compression chamber and the discharge-side refrigerant may be discharged, and the inside of the compressor may converge to the equilibrium pressure. Then, when the compressor operates again, the compressor may operate while a difference between the equilibrium pressure and a pressure at each position occurs.

It may be necessary to maintain the equilibrium pressure while the refrigerant of the back pressure chamber is discharged to the suction-side. If the refrigerant of the back pressure chamber is not discharged, the fixed scroll may be compressed downward by the pressure of the back pressure chamber, and thus, be maintained in a state in which the fixed scroll is closely attached to the orbiting scroll. Also, if the refrigerant of the back pressure chamber is not discharged, the pressure of the back pressure chamber may be maintained at the equilibrium pressure. Accordingly, the floating plate may move upward to contact the discharge cover. As a result, the discharge passage for the discharge-side refrigerant may be blocked, preventing the discharge-side refrigerant from being discharged to the suction-side of the compressor, thereby further compressing the fixed scroll downward.

As described above, when the fixed scroll is pressed to maintain the state in which the fixed scroll is closely attached to the orbiting scroll at a pressure greater than a predetermined pressure, it may be difficult to quickly drive the scroll compressor again. As a result, to quickly drive the scroll compressor again, a high initial torque of the compressor may be required. When the initial torque increases, noise and abrasion may occur, reducing operation efficiency of the compressor.

As described above, the refrigerant of the back pressure chamber has to be discharged toward the compression chamber and the suction-side when the operation of the compressor stops. However, in the case of the upper back pressure type scroll compressor according to the related art, when the compressor operates and then stops, the revolving orbiting scroll wrap may be disposed at one position of the head plate of the fixed scroll. The orbiting scroll may stop in a state in which an end of the orbiting scroll blocks a point of the head plate that communicates with the back pressure chamber, that is, a discharge hole to discharge the intermediate pressure refrigerant into the back pressure chamber.

When the discharge hole is blocked by the wrap of the orbiting scroll, discharge of the refrigerant of the back pressure chamber into the compression chamber and the suction-side may be limited. As a result, quick re-operation of the compressor may be limited. In addition, even though the refrigerant of the back pressure chamber is smoothly discharged, if the floating plate does not smoothly move downward, an equilibrium pressure reaching time within the compressor may increase.

FIG. 1 illustrates a variation in pressure within a scroll compressor when the scroll compressor according to the related art operates or stops. In FIG. 1, dotted line $P_1$ is a pressure of the refrigerant discharged from the scroll compressor, solid line $P_2$ is an intermediate pressure of the refrigerant of the back pressure chamber, dotted line $P_3$ is a pressure of the discharge cover-side refrigerant, and solid line $P_4$ is a pressure of the suction-side refrigerant.

Referring to FIG. 1, the scroll compressor according to the related art may stop at a time $t_0$ after the scroll compressor operates. After the scroll compressor is stopped, the inside of the scroll compressor may converge to a predetermined pressure.

However, as the refrigerant of the back pressure chamber is not discharged to the compression chamber and the suction-side of the scroll compressor, maintenance of the inner pressure of the compressor to the equilibrium pressure may be limited. That is, the equilibration between the suction-side pressure $P_4$ and other pressures may be limited to cause a predetermined pressure difference $\Delta P$.

Also, after the scroll compressor is stopped, the scroll compressor may quickly re-operate even though the scroll compressor re-operates at a time $t_1$. That is, the pressure difference within the scroll compressor has to be quickly generated while the orbiting scroll revolves. However, the orbiting scroll may re-operate at a time $t_2$ after a predetermined time has elapsed.

BRIEF DESCRIPTION OF THE DRAWINGS

Embodiments will be described in detail with reference to the following drawings in which like reference numerals refer to like elements, and wherein.

DETAILED DESCRIPTION

Figure 1:
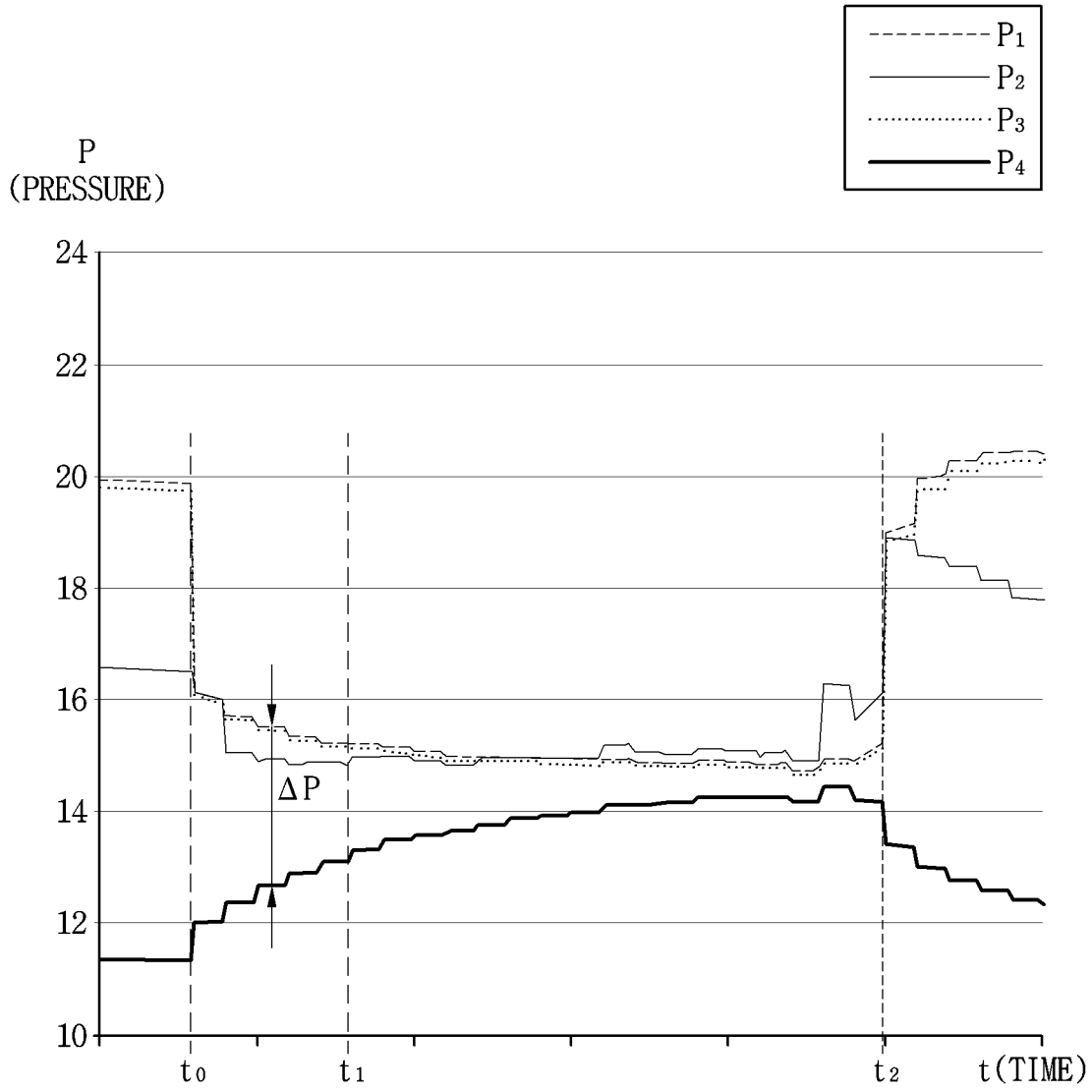
FIG. 1 illustrates a variation in pressure within a compressor when a scroll compressor according to a related art operates or stops.

Reference will now be made in detail to the embodiments, examples of which are illustrated in the accompanying drawings. Where possible, like reference numerals have been used to indicate like elements, and repetitive disclosure has been omitted.

In the following detailed description of embodiments, reference is made to the accompanying drawings that form a part hereof, and in which is shown by way of illustration specific embodiments which may be practiced. These embodiments are described in sufficient detail to enable those skilled in the art to practice the embodiments, and it is understood that other embodiments may be utilized and that logical structural, mechanical, electrical, and chemical changes may be made without departing from the spirit or scope. To avoid detail not necessary to enable those skilled in the art to practice the embodiments, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 2:
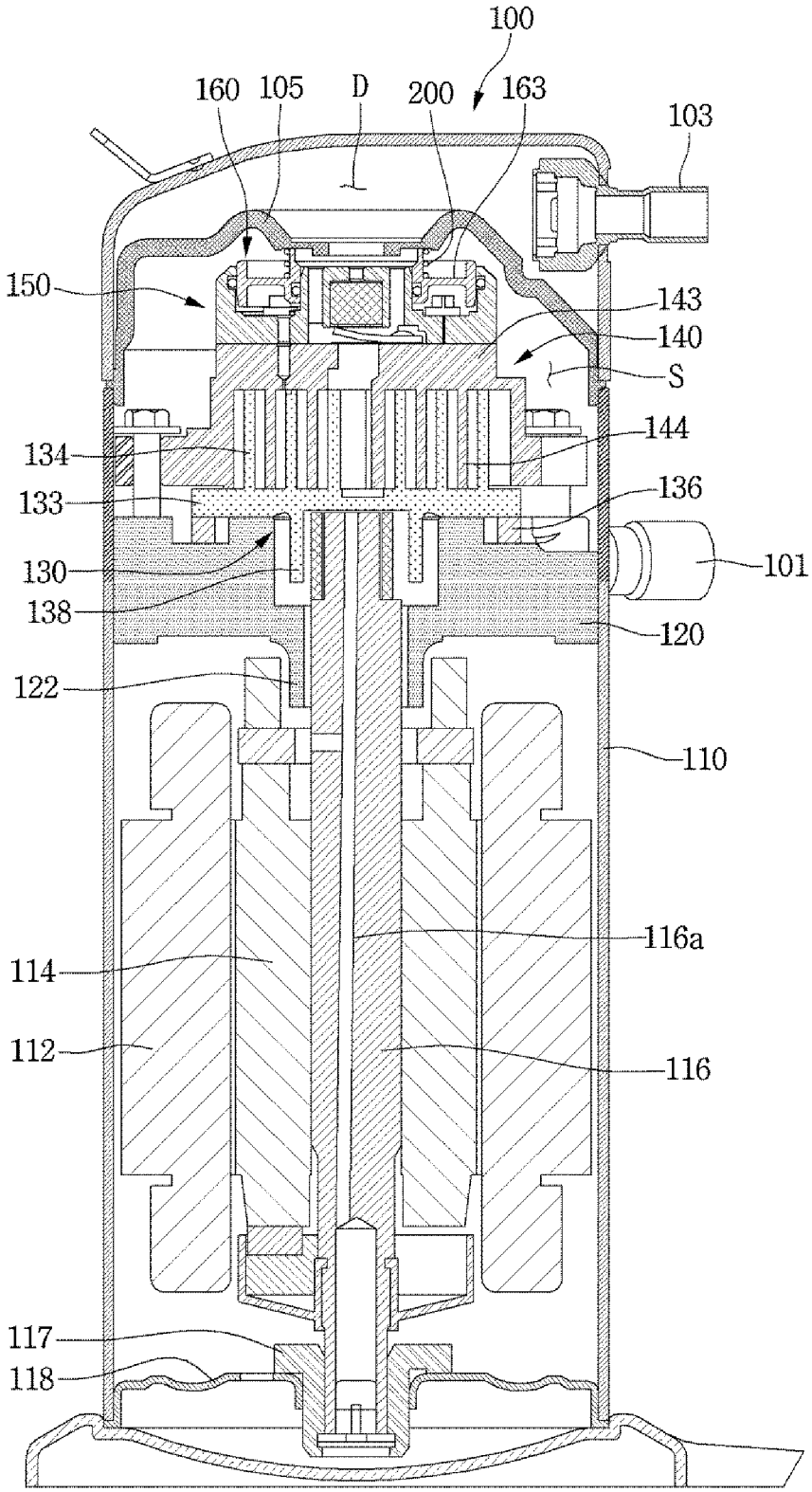
FIG. 2 is a cross-sectional view of a scroll compressor according to an embodiment.
Figure 3:
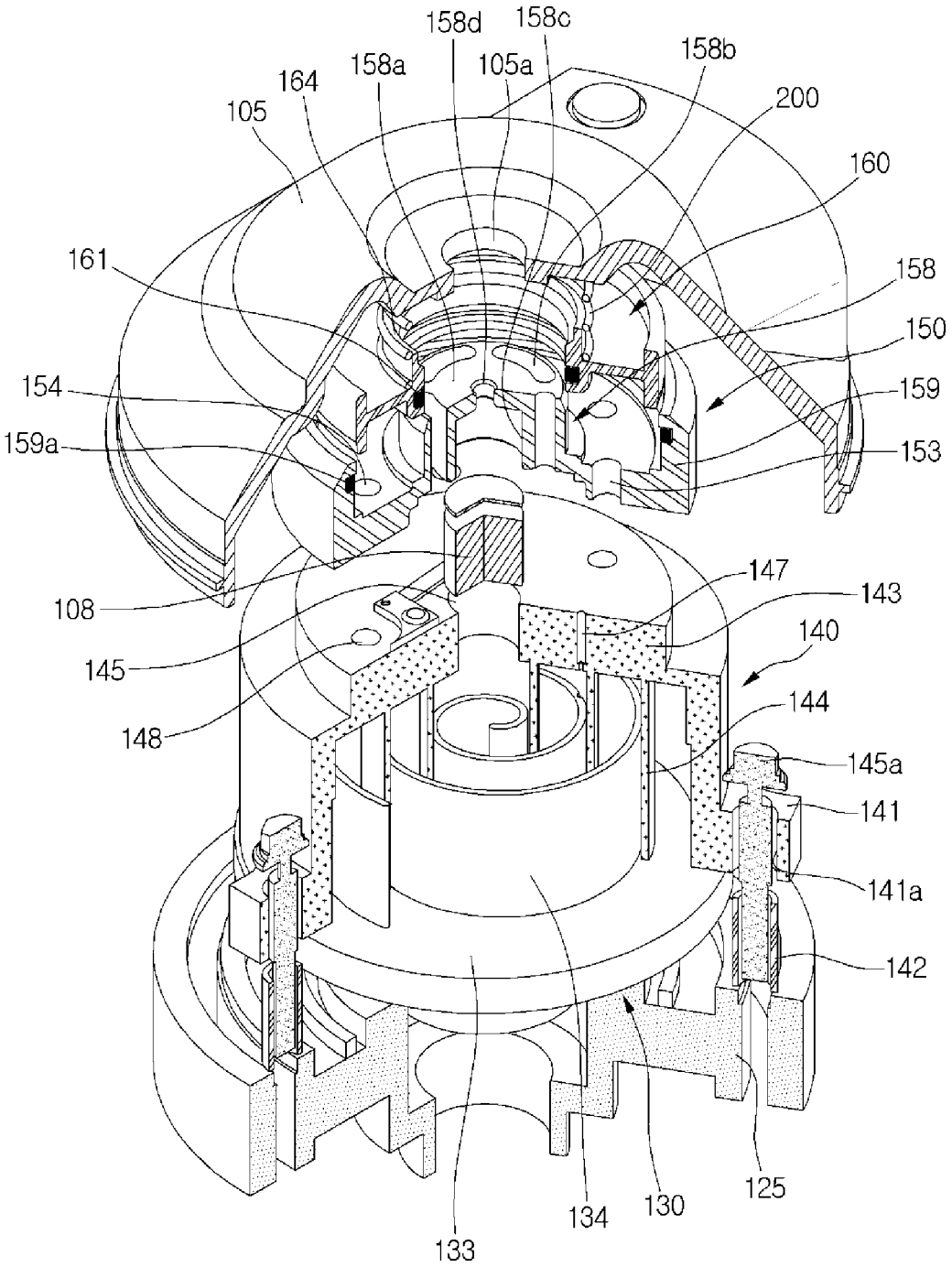
FIG. 3 is a partial exploded cross-sectional view of the scroll compressor of FIG. 2.
Figure 4:
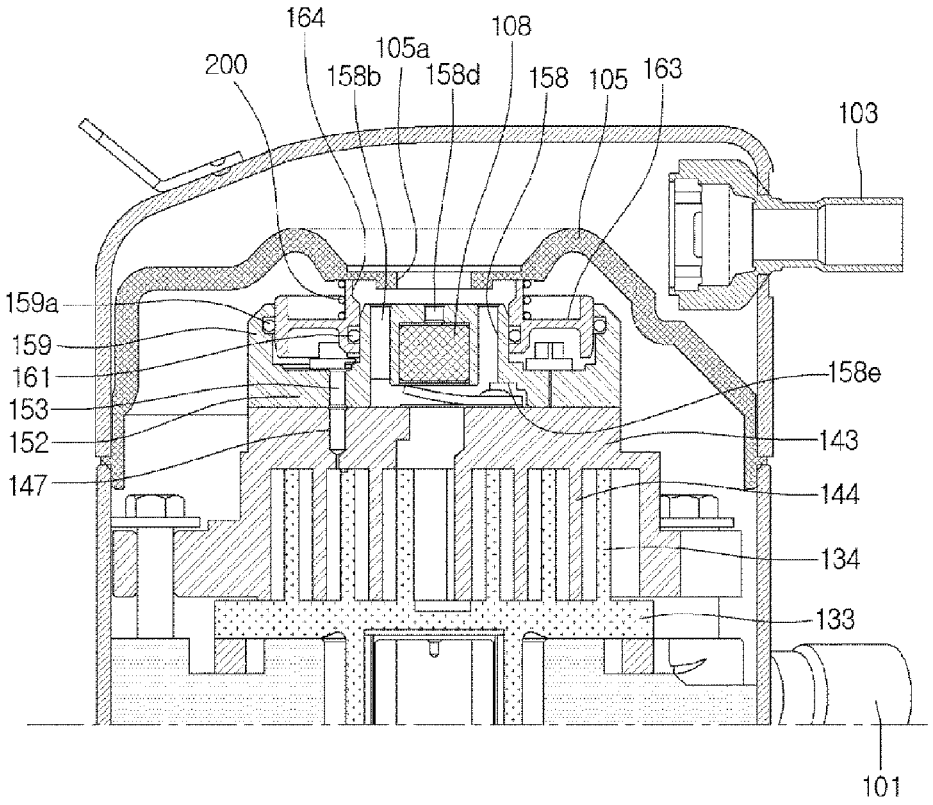
FIG. 4 is a partial cross-sectional view of the scroll compressor of FIG. 2.

FIG. 2 is a cross-sectional view of a scroll compressor according to an embodiment. FIG. 3 is a partial exploded cross-sectional view of the scroll compressor of FIG. 2. FIG. 4 is a partial cross-sectional view of the scroll compressor of FIG. 2.

Referring to FIGS. 2 to 4, a scroll compressor 100 according to an embodiment may include a casing 110 having a suction space S and a discharge space D. In detail, a discharge cover 105 may be disposed in or at an inner upper portion of the casing 110. An inner space of the casing 110 may be partitioned into the suction space S and the discharge space D by the discharge cover 105. An upper space of the discharge cover 105 may be the discharge space D, and a lower space of the discharge cover 105 may be the suction space S. A discharge hole 105*a*, through which a refrigerant compressed to a high pressure may be discharged, may be defined in an approximately central portion of the discharge cover 105.

The scroll compressor 100 may further include a suction port 101 that communicates with the suction space S, and a discharge port 103 that communicates with the discharge space D. Each of the suction port 101 and the discharge port 103 may be fixed to the casing 101 to allow the refrigerant to be suctioned into the casing 110 or discharged outside of the casing 110.

A motor may be disposed in the suction space S. The motor may include a stator 112 coupled to an inner wall of the casing 110, a rotor 114 rotatably disposed within the stator 112, and a rotational shaft 116 that passes through a central portion of the stator 114.

A lower portion of the rotational shaft 116 may be rotatably supported by an auxiliary bearing 117 disposed on or at a lower portion of the casing 110. The auxiliary bearing 117 may be coupled to a lower frame 118 to stably support the rotational shaft 116.

The lower frame 118 may be fixed to the inner wall of the casing 110, and an upper space of the lower frame 118 may be used as an oil storage space. Oil stored in the oil storage space may be transferred upward by an oil supply passage 116*a* defined in the rotational shaft 116 and uniformly supplied into the casing 110. The oil supply passage 116*a* may be eccentrically disposed toward one side of the rotational shaft 116, so that the oil introduced into the oil supply passage 116*a* may flow upward by a centrifugal force generated by rotation of the rotational shaft 116.

The scroll compressor 100 may further include a main frame 120. The main frame 120 may be fixed to the inner wall of the casing 110 and disposed in the suction space S.

An upper portion of the rotational shaft 116 may be rotatably supported by the main frame 120. A main bearing 122 that protrudes in a downward direction may be disposed on a bottom surface of the main frame 120. The rotational shaft 116 may be inserted into the main bearing 122. An inner wall of the main bearing 122 may function as a bearing surface so that the rotational shaft 116 may smoothly rotate.

The scroll compressor 100 may further include an orbiting scroll 130, and a fixed scroll 140. The orbiting scroll 130 may be seated on a top surface of the main frame 120.

The orbiting scroll 130 may include an orbiting head plate 133 having an approximately disk shape and disposed on the main frame 120, and an orbiting wrap 134 having a spiral shape and extending from the orbiting head plate 133. The orbiting head plate 133 may define a lower portion of the orbiting scroll 130 and function as a main body of the orbiting scroll 130, and the orbiting wrap 134 may extend in an upward direction from the orbiting head plate 133 to define an upper portion of the orbiting scroll 130. The orbiting wrap 134 together with a fixed wrap 144 of the fixed scroll 140 may define a compression chamber. The orbiting scroll 130 may be referred to as a "first scroll", and the fixed scroll 140 may be referred to as a "second scroll".

The orbiting head plate 133 of the orbiting scroll 130 may revolve in a state in which the orbiting head plate 133 is supported on the top surface of the main frame 120. An Oldham ring 136 may be disposed between the orbiting head plate 133 and the main frame 120 to prevent the orbiting scroll 130 from revolving. Also, a boss 138, into which the upper portion of the rotational shaft 116 may be inserted, may be disposed on a bottom surface of the orbiting head plate 133 of the orbiting scroll 130 to easily transmit a rotational force of the rotational shaft 116 to the orbiting scroll 130.

The fixed scroll 140 engaged with the orbiting scroll 130 may be disposed on the orbiting scroll 130. The fixed scroll 140 may include a plurality of coupling guides 141, each of which may define a guide hole 141*a*.

The orbiting scroll 130 may further include a guide pin 142 inserted into the guide hole 141*a* and disposed on a top surface of the main frame 120, and a coupling member 145*a* inserted into the guide pin 142 and fitted into an insertion hole 125 of the main frame 120.

The fixed scroll 140 may include a fixed head plate 143 having an approximately disk shape, and the fixed wrap 144 that extends from the fixed head plate 143 toward the orbiting head plate 133 and engaged with the orbiting wrap 134 of the orbiting scroll 130. The fixed head plate 143 may define an upper portion of the fixed scroll 140 and function as a main body of the fixed scroll 140, and the fixed wrap 144 may extend in a downward direction from the fixed head plate 143 to define a lower portion of the fixed scroll 140. The orbiting head plate 133 may be referred to as a "first head plate", and the fixed head plate 143 may be referred to as a "second head plate". The orbiting wrap 134 may be referred to as a "first wrap", and the fixed wrap 144 may be referred to as a "second wrap".

An end of the fixed wrap 144 may be disposed to contact the orbiting head plate 133, and an end of the orbiting wrap 134 may be disposed to contact the fixed head plate 143. The fixed wrap 144 may disposed in a predetermined spiral shape, and a discharge hole 145, through which the compressed refrigerant may be discharged, may be defined in an approximately central portion of the fixed head plate 143. A suction hole (see reference numeral 146 of FIG. 5), through which the refrigerant within the suction space S may be suctioned, may be defined in a side surface of the fixed scroll 140. The refrigerant suctioned through the suction hole 146 may be introduced into the compression chamber defined by the orbiting wrap 134 and the fixed wrap 144.

In detail, the fixed wrap 144 and the orbiting wrap 134 may define a plurality of compression chambers. Each of the plurality of compression chambers may be reduced in volume while revolving and moving toward the discharge hole 145 to compress the refrigerant. Thus, the compression chamber, which is adjacent to the suction hole 146, of the plurality of compression chambers may be minimized in pressure, and the compression chamber that communicates with the discharge hole 145 may be maximized in pressure. Also, the compression chamber between the above-described compression chambers may have an intermediate pressure that corresponds to a pressure between a suction pressure of the suction hole 146 and a discharge pressure of the discharge hole 145. The intermediate pressure may be applied to a back pressure chamber BP, which will be described hereinbelow, to press the fixed scroll 140 toward the orbiting scroll 130.

An intermediate pressure discharge hole 147 that transfers the refrigerant of the compression chamber having the intermediate pressure to the back pressure chamber BP may be defined in the fixed head plate 143 of the fixed scroll 140. That is, the intermediate pressure discharge hole 147 may be defined in one portion of the fixed scroll 140 so that the compression chamber that communicates with the intermediate pressure discharge hole 147 has a pressure greater than the suction pressure in the suction space S and less than the discharge pressure in the discharge space D. The intermediate pressure discharge hole 147 may pass through the fixed head plate 143 from a top surface to a bottom surface of the fixed head plate 143.

A back pressure chamber assembly 150 and 160 disposed above the fixed scroll 140 to define the back pressure chamber may be disposed on the fixed scroll 140. The back pressure chamber assembly 150 and 160 may include a back pressure plate 150, and a floating plate 160 separably coupled to the back pressure plate 150. The back pressure plate 150 may be fixed to an upper portion of the fixed head plate 143 of the fixed scroll 140.

The back pressure plate 150 may have an approximately annular shape with a hollow and include a support 152 that contacts the fixed head plate 143 of the fixed scroll 140. An intermediate pressure suction hole 153 that communicates with the intermediate pressure discharge hole 147 may be defined in the support 152. The intermediate pressure suction hole 153 may pass through the support 152 from a top surface to a bottom surface of the support 152.

A second coupling hole 154 that communicates with the first coupling hole 148 defined in the fixed head plate 143 of the fixed scroll 140 may be defined in the support 152. The first coupling hole 148 and the second coupling hole 154 may be coupled to each other by a coupling member (not shown).

The back pressure plate 150 may include a plurality of walls 158 and 159 that extend in an upward direction from the support 152. The plurality of walls 158 and 159 may include a first wall 158 that extends in the upward direction from an inner circumferential surface of the support 152, and a second wall 159 that extends in the upward direction from an outer circumferential surface of the support 152. Each of the first and second walls 158 and 159 may have an approximately cylindrical shape.

The first and second walls 158 and 159 together with the support 152 may define a space. A portion of the space may be a back pressure chamber BP.

The first wall 158 may include a top surface 158*a* that defines a top surface of the first wall 158. The first wall 158 may include at least one intermediate discharge hole 158*b* that communicates with the discharge hole 145 of the fixed head plate 143 to discharge the refrigerant discharged from the discharge hole 145 toward the discharge cover 105. The intermediate discharge hole 158*b* may pass from a bottom surface of the first wall 158 to the top surface 158*a*. An inner space of the first wall 158 having a cylindrical shape may communicate with the discharge hole 145 to define a portion of a discharge passage through which the discharged refrigerant may flow into the discharge space D.

A discharge valve 108 having an approximately circular pillar shape may be disposed inside the first wall 158. The discharge valve 108 may be disposed above the discharge hole 145 and have a size sufficient to completely cover the discharge hole 145. For example, the discharge valve 108 may have an outer diameter greater than a diameter of the discharge hole 145. Thus, when the discharge valve 108 contacts the fixed head plate 143 of the fixed scroll 140, the discharge valve 108 may close the discharge hole 145.

The discharge valve 108 may be movable in upward or downward directions according to a variation in pressure applied to the discharge valve 108. Also, the inner circumferential surface of the first wall 158 may define a moving guide 158*c* that guides movement of the discharge valve 108.

A discharge pressure apply hole 158*d* may be defined in the top surface 158*a* of the first wall 158. The discharge pressure apply hole 158*d* may communicate with the discharge hole 105*a*. The discharge pressure apply hole 158*d* may be defined in an approximately central portion of the top surface 158*a*, and the plurality of intermediate discharge holes 158*b* may be disposed to surround the discharge pressure apply hole 158*d*.

For example, when operation of the scroll compressor 100 is stopped, if the refrigerant flows backward from the discharge space D toward the discharge hole 145, the pressure applied to the discharge pressure apply hole 158*d* may be greater than the discharge hole-side pressure. That is, the pressure may be applied downward to a top surface of the discharge valve 108, and thus, the discharge valve 108 may move downward to close the discharge hole 145.

On the other hand, if the scroll compressor 100 operates to compress the refrigerant in the compression chamber, when the discharge hole-side pressure is greater than the pressure in the discharge space D, an upward pressure may be applied to a bottom surface of the discharge valve 108, and thus, the discharge valve 108 may move upward to open the discharge hole 145. When the discharge hole 145 is opened, the refrigerant discharged from the discharge hole 145 may flow toward the discharge cover 105 via the intermediate discharge hole 158*b*, and then, may be discharged outside of the scroll compressor 100 through the discharge port 103 via the discharge hole 105*a*.

The back pressure plate 150 may further include a step 158*e* disposed inside a portion at which the first wall 158 and the support 152 are connected to each other. The refrigerant discharged from the discharge hole 145 may reach a space defined by the step 158*e* and then flow to the intermediate discharge hole 158*b*.

The second wall 159 may be spaced a predetermined distance from the first wall 158 to surround the first wall 158. The back pressure plate 150 may have a space having an approximately U-shaped cross-section formed by the first wall 158, the second wall 159, and the support 152. The floating plate 160 may be accommodated in the space. The space, which may be covered by the floating plate 160, may form the back pressure chamber BP. On the other hand, the first and second walls 158 and 159 of the back pressure plate 150, the support 152, and the floating plate 160 may define the back pressure chamber BP.

The floating plate 160 may include an inner circumferential surface that faces an outer circumferential surface of the first wall 158, and an outer circumferential surface that faces an inner circumferential surface of the second wall 159. That is, the inner circumferential surface of the floating plate 160 may contact the outer circumferential surface of the first wall 158, and the outer circumferential surface of the floating plate 160 may contact the inner circumferential surface of the second wall 159.

The floating plate 160 may have an inner diameter equal to or greater than an outer diameter of the first wall 158 of the back pressure plate 150. The floating plate 160 may have an outer diameter equal to or less than an inner diameter of the second wall 159 of the back pressure plate 150.

Sealing members 159*a*, 161 to prevent the refrigerant within the back pressure chamber BP from leaking may be disposed on the first and second walls 158 and 159 and the floating plate 160, respectively. The sealing members 159*a* and 161 may include a first O-ring 159*a* to prevent the refrigerant from leaking between an inner circumferential surface of the second wall 159 and an outer circumferential surface of the floating plate 160, and a second O-ring 161 to prevent the refrigerant from leaking between an outer circumferential surface of the first wall 158 and an inner circumferential surface of the floating plate 160. For example, the first O-ring 159*a* may be disposed on the inner circumferential surface of the second wall 159, and the second O-ring 161 may be disposed on the inner circumferential surface of the floating plate 160. Alternatively, the first O-ring 159*a* may be disposed on the outer circumferential surface of the floating plate 160, and the second O-ring 161 may be disposed on the outer circumferential surface of the first wall 158. Leakage between the first and second walls 158 and 159 and the floating plate 160, that is, the refrigerant leakage from the back pressure chamber BP may be prevented by the O-rings 159*a* and 161.

A rib 164 that extends in an upward direction may be disposed on a top surface of the floating plate 160. For example, the rib 164 may extend in the upward direction from the inner circumferential surface of the floating plate 160.

When the floating plate 160 ascends, the rib 164 may contact a bottom surface of the discharge cover 105. When the rib 164 contacts the discharge cover 105, communication between the suction space S and the discharge space D may be blocked. On the other hand, when the rib 164 is spaced apart from the bottom surface of the discharge cover 105, that is, when the rib 164 moves in a direction away from the discharge cover 105, the suction space S and the discharge space D may communicate with each other.

In detail, while the scroll compressor 100 operates, the floating plate 160 may move upward to allow the rib 164 to contact the bottom surface of the discharge cover 105. Thus, the refrigerant discharged from the discharge hole 145 to pass through the intermediate discharge hole 158*b* may not leak into the suction space S, but rather, may be discharged into the discharge space D.

On the other hand, when the scroll compressor 100 is stopped, the floating plate 160 may move downward to allow the rib 164 to be spaced apart from the bottom surface of the discharge cover 105. Thus, the discharged refrigerant disposed at the discharge cover-side may flow toward the suction space S through the space between the rib 164 and the discharge cover 105. Also, when the scroll compressor 100 is stopped, the floating plate 160 may move upward to allow the rib 164 to be spaced apart from the bottom surface of the discharge cover 105.

The scroll compressor 100 may further include an elastic member 200 to press the floating plate 160 toward the fixed scroll 140. The elastic member 200 may be disposed between the discharge cover 105 and the floating plate 160.

An elastic member accommodation portion 163 that accommodates the elastic member 200 may be provided in the top surface 158*a* of the floating plate 160. For example, the elastic member accommodation portion 163 may be a recess defined by recessing the top surface 158*a* of the floating plate 160 in a downward direction. As another example, the elastic member accommodation portion 163 may be a protrusion that protrudes in an upward direction from the top surface 158*a* of the back pressure plate 160.

A lower portion of the elastic member 200 may be accommodated into the elastic member accommodation portion 163, and an upper portion of the elastic member 200 may contact a bottom surface of the discharge cover 105. For example, the elastic member 200 may be a coil spring. The coil spring may have a cylindrical or truncated cone shape. Also, the coil spring may surround the rib 164 of the floating plate 160 in a state in which the coil spring is accommodated in the elastic member accommodation portion 163.

The coil spring may be a compression coil spring, for example. When the coil spring is provided as the compression coil spring, the coil spring may press the floating plate 160 toward the fixed scroll 140. That is, the coil spring may provide an elastic force to the floating plate 160 so the floating plate 160 moves in a direction away from the discharge cover 105. Also, when the refrigerant having the intermediate pressure is introduced into the back pressure chamber BP, the floating plate 160 may move in a direction closer to the discharge cover 105 to press the coil spring. Also, when the scroll compressor 100 stops, the elastic force of the coil spring may act on the floating plate 160, and thus, the floating plate 160 may move upward to allow the rib 164 to be spaced apart from a bottom surface of the discharge cover 105.

As the second O-ring 161 is disposed on the inner circumferential surface of the floating plate 160, if the coil spring is not provided, the floating plate 160 may not smoothly move downward due to friction force between the second O-ring 161 and the first wall 158 even though the scroll compressor 100 stops. In this case, an equilibrium pressure reaching time within the scroll compressor 100 may increase, and thus, it may take a longer time to re-operate the scroll compressor 100.

However, according to this embodiment, when the scroll compressor 100 stops, as the elastic force of the coil spring acts on the floating plate 160 to allow the floating plate 160 to smoothly move downward due to the elastic force of the coil spring, the equilibrium pressure reaching time within the scroll compressor 100 may decrease to reduce the re-operation time of the scroll compressor 100. As the coil spring is disposed to surround the rib 164 of the floating plate 160, the elastic force of the coil spring may uniformly act on the floating plate 160 to tilt the floating plate 160, thereby minimizing downward movement of the floating plate 160. Thus, the floating plate 160 may be quickly spaced apart from the discharge cover 105.

Also, as the coil spring presses the back pressure plate 160 toward the fixed scroll 140, the floating plate 160 may press the back pressure plate 150 downward, and the back pressure plate 150 may press the fixed scroll 140 downward. That is, the pressing force due to the coil spring may be transmitted to the fixed scroll 140. Thus, when the scroll compressor 100 initially operates, upward movement of the fixed scroll 140 due to the refrigerant introduced into the compression chamber may be prevented.

Figure 5:
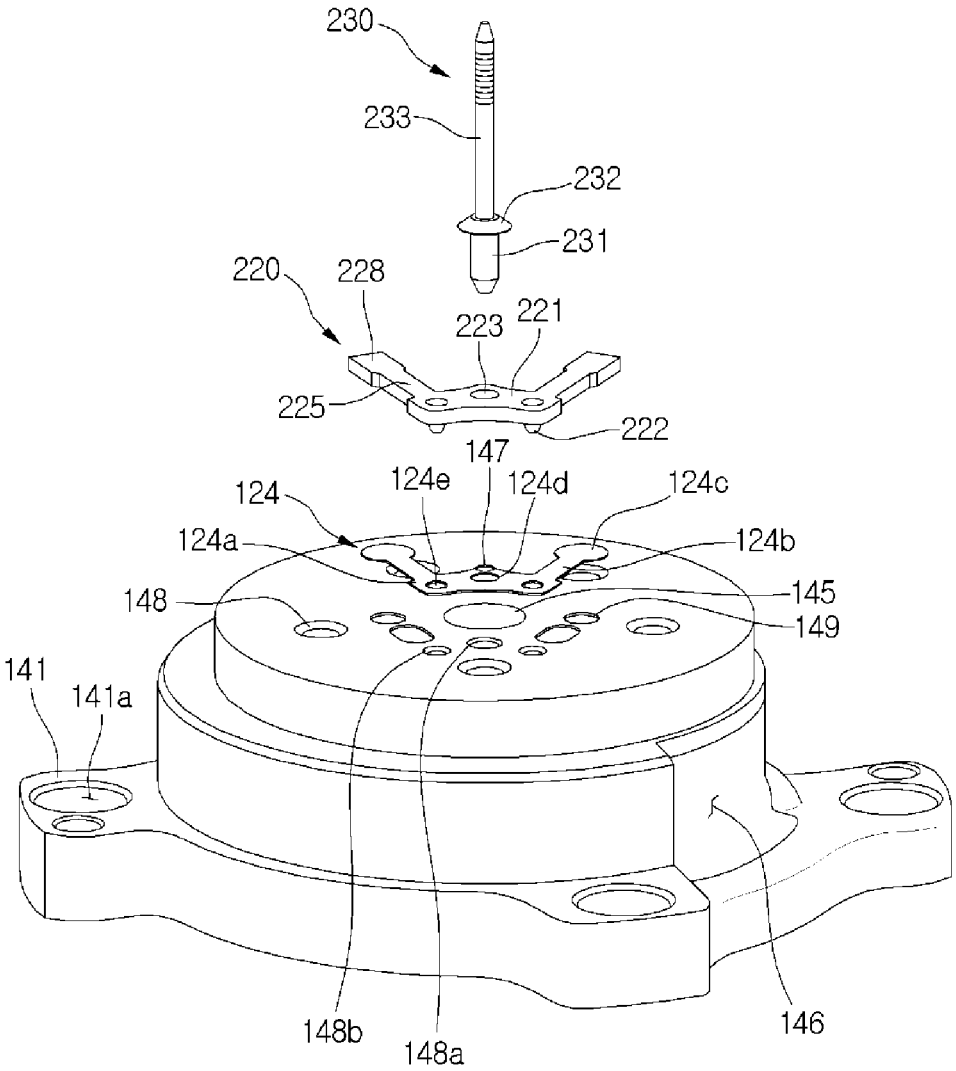
FIG. 5 is a perspective view of a fixed scroll according to an embodiment.
Figure 6:
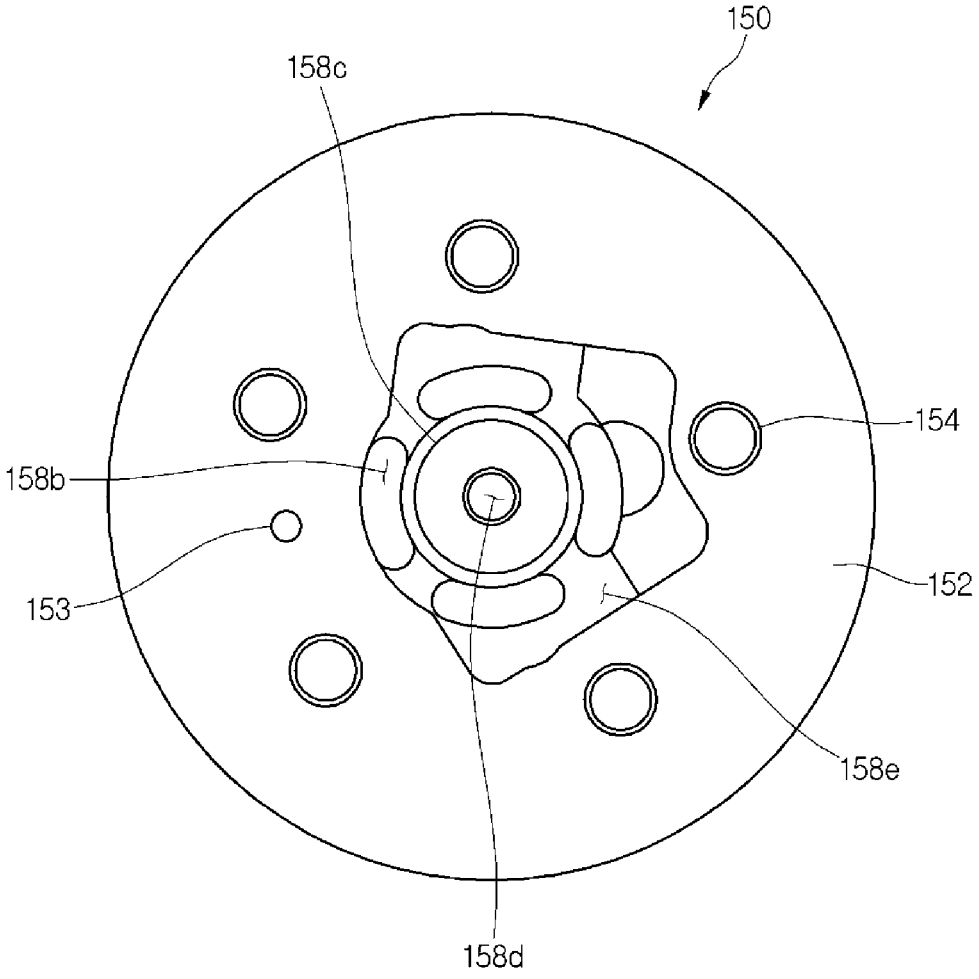
FIG. 6 is a view illustrating a bottom surface of a back pressure plate according to an embodiment.

FIG. 5 is a perspective view of a fixed scroll according to an embodiment. FIG. 6 is a view illustrating a bottom surface of a back pressure plate according to an embodiment.

Referring to FIGS. 3, 5 and 6, the fixed scroll 140 according to an embodiment may include at least one bypass hole 149 defined in one side of the discharge hole 145. Although two bypass holes 149 are shown in FIG. 5, embodiments are not limited to the number of bypass holes 149. Each bypass holes 149 may pass through the fixed head plate 143 to extend up to the compression chamber defined by the fixed wrap 144 and the orbiting wrap 134.

The bypass hole(s) 149 may be defined in different positions according to operation conditions. For example, the bypass hole 149 may communicate with the compression chamber having a pressure greater by about 1.5 times than the suction pressure. Also, the compression chamber that communicates with the bypass hole 149 may have a pressure greater than the pressure of the compression chamber that communicates with the intermediate pressure discharge hole 147.

The scroll compressor 100 may further include a bypass valve 124 that opens and closes the bypass hole(s) 149, a stopper 220 that restricts a moving distance of the bypass valve 124 when the bypass valve 124 opens the bypass hole(s) 149, and a coupling member 230 that couples the bypass valve 124 and the stopper 220 to the fixed scroll 140 at the same time. In detail, the bypass valve 124 may include a valve support 124*a* fixed to the fixed head plate 143 of the fixed scroll 140 by the coupling member 230. The bypass valve 124 may further include at least one connection portion 124*b* that extends from the valve support 124*a*, and at least one valve body 124*c* disposed on or at a side of the connection portion 124*b*. Each of the at least one connection portion 124*b* and the at least one valve body 124*c* may be provided in a same number as a number of the bypass hole(s) 149. For example, FIG. 5 illustrates the bypass valve 124 including two connection portions 124*b* and two valve bodies 124*c*.

The valve body 124*c* may be maintained in contact with the top surface of the fixed head plate 143 and have a size sufficient to cover the bypass hole 149. Further, the valve body 124*c* may be moved by a pressure of the refrigerant flowing along the bypass hole 149 to open the bypass hole 149. Thus, the connection portion 124*b* may have a size less than a diameter of the valve body 124*c* so that the valve body 124*c* may smoothly move.

When the bypass valve 124 opens the bypass hole 149, the refrigerant of the compression chamber that communicates with the bypass hole 149 may flow into a space between the fixed scroll 140 and the back pressure plate 150 through the bypass hole 149 to bypass the discharge hole 145. The bypassed refrigerant may flow toward the discharge hole 105*a* of the discharge cover 105 via the intermediate discharge hole 158*b*.

The stopper 220 may be disposed above the bypass valve 124. The stopper 220 may have a shape corresponding to a shape of the bypass valve 124. The bypass valve 124 may be elastically deformed by the refrigerant pressure. As the stopper 220 restricts movement of the bypass valve 124, the stopper 220 may have a thickness greater than a thickness of the bypass valve 124.

The stopper 220 may include a stopper support 221 that contacts the valve support 124*a*. The stopper 220 may further include at least one connection portion 225 that extends from the stopper support 221, and at least one stopper body 228 disposed on or at one side of the connection portion 225. Each of the at least one connection portion 225 of the at least one stopper 220 and the at least one stopper body 228 may be provided in a same number as a number of the connection portions 124*b* of the bypass valve 124 and the valve body 124*c*.

Each connection portion 225 of the stopper 220 may be inclined in an upward direction away from the stopper support 221. Thus, the valve body 124*c* may contact a top surface of the fixed head plate 143, and the stopper body 228 may be spaced apart from a top surface of the valve body 124*c* in a state in which the bypass valve 124 and the stopper 220 are coupled to the fixed head plate 143 by the coupling member 230. When the valve body 124*c* is lifted upward by the refrigerant flowing through the bypass hole 149, the top surface of the valve body 124*c* may contact the stopper body 228, and thus, the valve body 124*c* may be stopped.

Coupling holes 223 and 124*d*, to which the coupling member 230 may be coupled, may be defined in the stopper support 221 and the bypass valve 124. A coupling groove 148*a*, to which the coupling member 230 may be coupled, may be defined in the fixed head plate 143.

At least one guide protrusion 222 to maintain an arranged state of the coupling holes 223 and 124*d* and the coupling groove 148*a* before the coupling member 230 is coupled to each of the coupling holes 223 and 124*d* and the coupling groove 149*a* may be disposed on the stopper support 221. At least one protrusion through-hole 124*e*, through which the guide protrusion 222 may pass, may be defined in the valve support 221. At least one protrusion accommodation groove 148*b* that accommodates the guide protrusion 222 may be defined in the fixed head plate 143. Thus, when the guide protrusion 222 of the stopper 220 is accommodated into the protrusion accommodation groove 148*b* in a state in which the guide protrusion 222 passes through the protrusion through-hole 124*e* of the bypass valve 124, the stopper support 221, the bypass valve 124, and each of the coupling holes 223 and 124*d* and the coupling groove 149*a* of the fixed head plate 143 may be aligned with each other.

The stopper 220 may include a plurality of the guide protrusion 222, the bypass valve 124 may include a plurality of the through-hole 124*e*, and the fixed scroll 140 may include a plurality of the protrusion accommodation groove 148*b*, so that the stopper support 221, the bypass valve 124, and the coupling holes 223 and 124*d* and coupling groove 148*a* of the fixed head plate 143 may be more accurately aligned with each other. In this case, the coupling groove 223 may be disposed between the plurality of guide protrusions 222 of the stopper 220. Also, the coupling groove 124*d* may be disposed between the plurality of through-holes 124*e* of the bypass valve 124, and the coupling groove 148*a* may be disposed between the plurality of protrusion accommodation grooves 148*b* of the fixed head plate 143.

The coupling member 230 may be a rivet, for example. The coupling member 230 may include a coupling body 231 coupled to the stopper support 221, the bypass valve 124, and the coupling holes 223 and 124*d* and the coupling groove 148*a* of the fixed head plate 143, a head 232 disposed on the coupling body 231 to contact a top surface of the stopper support 221, and a separation portion 233 that passes through the head 232, disposed inside the coupling body 231, and being separable from the coupling body 231. When the separation portion 233 is pulled upward in FIG. 5, the separation portion 233 may be separated from the coupling body 231.

According to this embodiment, a configuration and coupling method of the coupling member 230 may be realized through well-known technology, and thus, detailed description thereof has been omitted.

The intermediate pressure discharge hole 147 of the fixed scroll 140 and the intermediate pressure suction hole 153 of the back pressure plate 150 may be disposed to be aligned with each other. The refrigerant discharged from the intermediate pressure discharge hole 147 may be introduced into the back pressure chamber BP via the intermediate pressure suction hole 153. The intermediate pressure discharge hole 147 and the intermediate pressure suction hole 153 may be referred to as a "bypass passage" in that the refrigerant of the back pressure chamber BP may be bypassed to the compression chamber through the intermediate pressure discharge hole 147 and the intermediate pressure suction hole 153.

Figure 7:
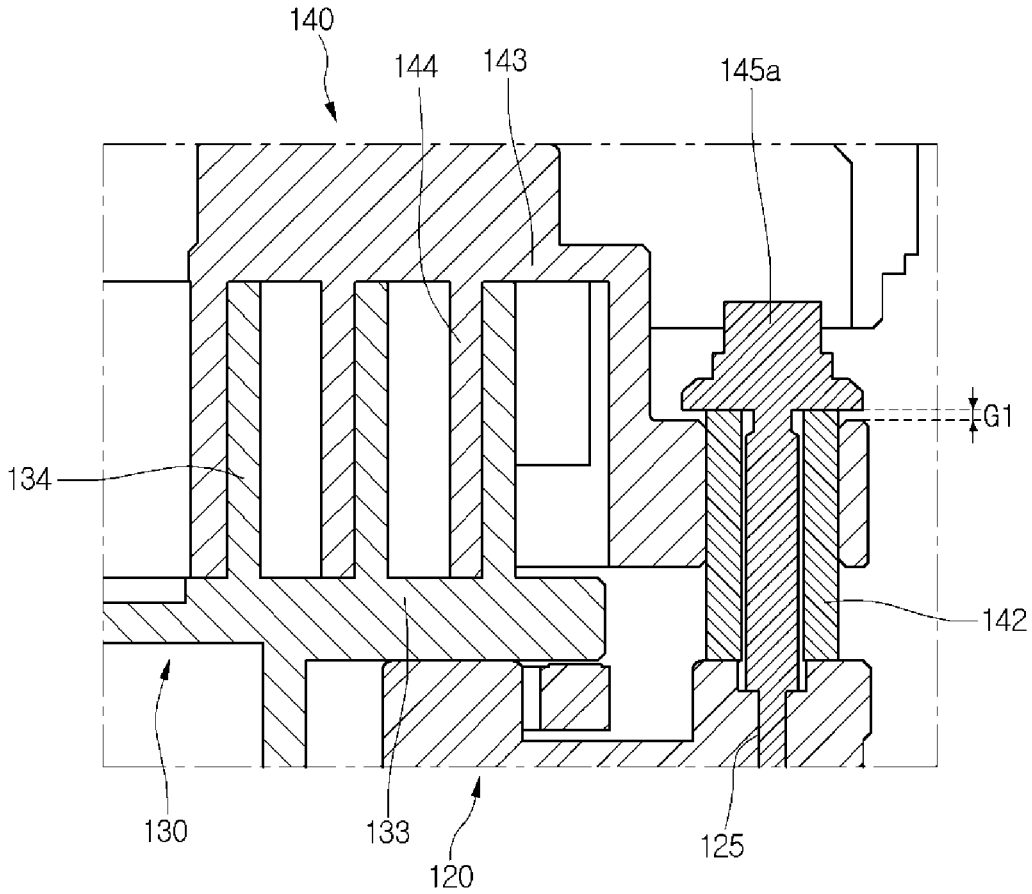
FIG. 7 is a view illustrating a state in which the fixed scroll is coupled to a main frame according to an embodiment.
Figure 8:
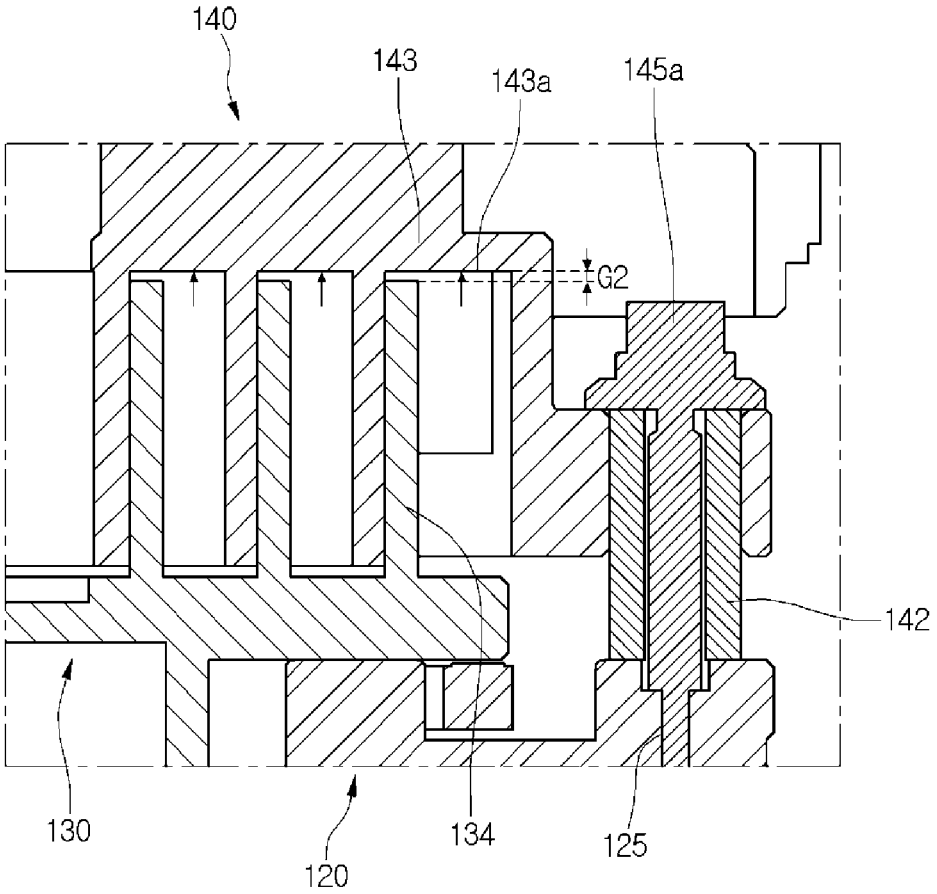
FIG. 8 is a view illustrating a state in which the fixed scroll moves upward by a predetermined distance in the state in which the fixed scroll is coupled to the main frame according to an embodiment.

FIG. 7 is a view illustrating a state in which the fixed scroll is coupled to a main frame according to an embodiment. FIG. 8 is a view illustrating a state in which the fixed scroll moves upward by a predetermined distance in the state in which the fixed scroll is coupled to the main frame according an embodiment.

Referring to FIGS. 7 and 8, in a state in which the orbiting scroll 130 is seated on the main frame 120, the fixed scroll 140 may be seated on the orbiting scroll 130, the guide pin 142 may pass through the coupling guide 141 of the fixed scroll 140 and then be seated on the main frame 120. Also, the coupling member 145*a* may pass through the guide pin 142 and then be coupled to the insertion hole 125 of the main frame 120. The guide pin 142 may have a cylindrical shape, and an outer diameter greater than a diameter of the insertion hole.

In a state in which the coupling member 145*a* is coupled to the main frame 120, the fixed wrap 144 of the fixed scroll 140 may contact the orbiting head plate 133 of the orbiting scroll 130, and the orbiting wrap 134 of the orbiting scroll 130 may contact the fixed head plate 143 of the fixed scroll 140. In this state, a top surface of the coupling guide 141 of the fixed scroll 140 may be spaced apart from a head of the coupling member 145*a* to form a gap G1.

The gap G1 may be formed between the top surface of the coupling guide 141 of the fixed scroll 140 and the head of the coupling member 145*a* to prevent the fixed wrap 144 of the fixed scroll 140 from being excessively closely attached to the orbiting head plate 133 or prevent the orbiting wrap 134 of the orbiting scroll 130 from being excessively closely attached to the fixed head plate 143 of the fixed scroll 140 while the fixed scroll 140 is coupled to the main frame 120 by a tolerance occurring when the fixed scroll 140 and the orbiting scroll 130 are manufactured. Thus, when the scroll compressor 100 initially operates from a stopped state, that is, when suction of refrigerant starts, the fixed scroll 140 may be lifted upward by a suction pressure of the refrigerant. That is, a gap G2 may be formed between an upper end of the orbiting wrap 134 of the orbiting scroll 130 and a bottom surface 143*a* of the fixed head plate 143 of the fixed scroll 140.

Also, when the refrigerant is compressed while the scroll compressor 100 operates, the refrigerant having the intermediate pressure may be introduced into the back pressure chamber BP, and the fixed scroll 140 may move downward by a pressure of the back pressure chamber BP to allow the fixed scroll 140 to be closely attached to the orbiting scroll 130. If the gap G2 formed between the upper end of the orbiting wrap 134 of the orbiting scroll 130 and the bottom surface 143*a* of the fixed head plate 143 of the fixed scroll 140 is large, the plurality of compression chambers defined by the orbiting wrap 134 and the fixed wrap 144 may not be sealed therebetween. Thus, it may take a long time for the back pressure chamber BP to reach a desired pressure required to move the fixed scroll 140 downward.

However, according to this embodiment, as the elastic member 200 disposed between the floating plate 160 and the discharge cover 105 presses the floating plate 160, and thus, the fixed scroll 140 is pressed downward, the gap G2 formed between the upper end of the orbiting wrap 134 of the orbiting scroll 130 and the bottom surface 143 of the fixed head plate 143 of the fixed scroll 140 may be minimized when the scroll compressor 100 initially operates.

Figure 9:
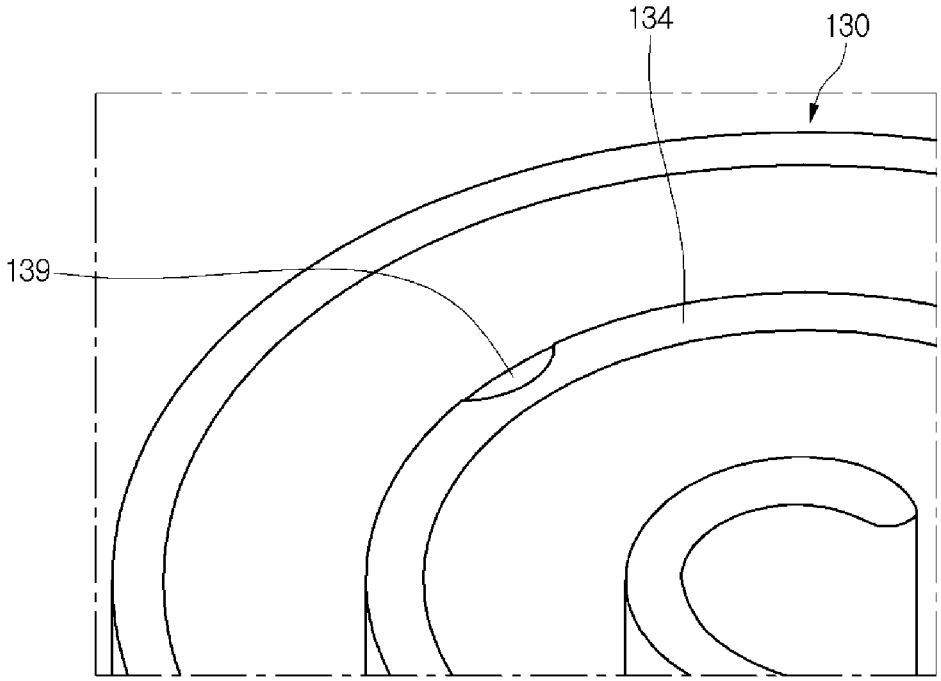
FIG. 9 is a partial view of an orbiting scroll according to an embodiment.
Figure 10:
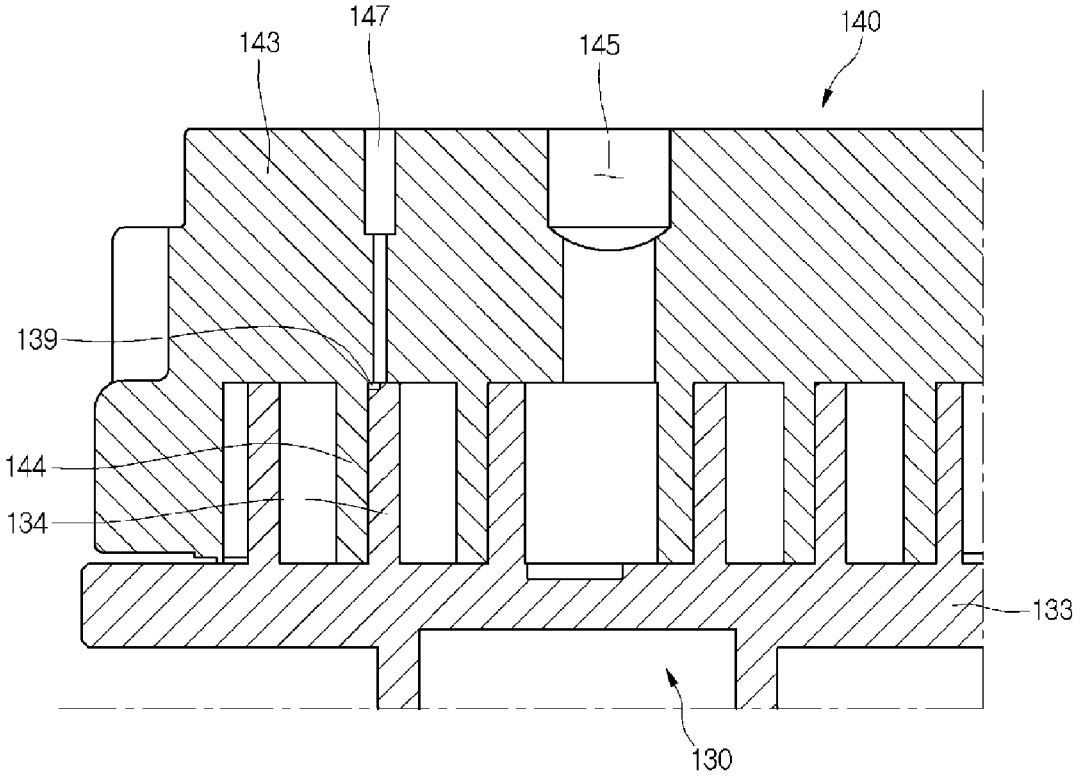
FIG. 10 is a cross-sectional view illustrating a state in which the fixed scroll and the orbiting scroll are coupled to each other according to an embodiment.
Figure 11A:
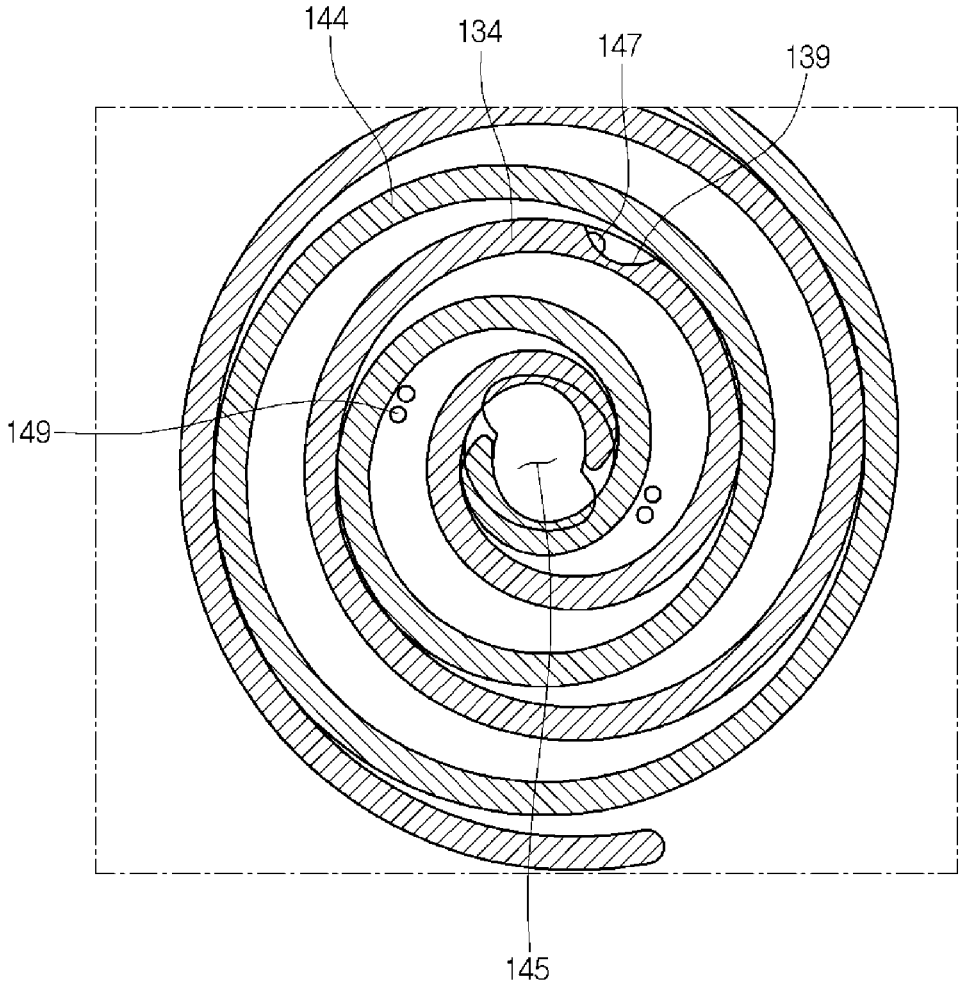
FIGS. 11A to 11C are views illustrating relative positions of an intermediate pressure discharge hole of the fixed scroll and a discharge guide of the orbiting scroll while the orbiting scroll revolves.
Figure 11B:
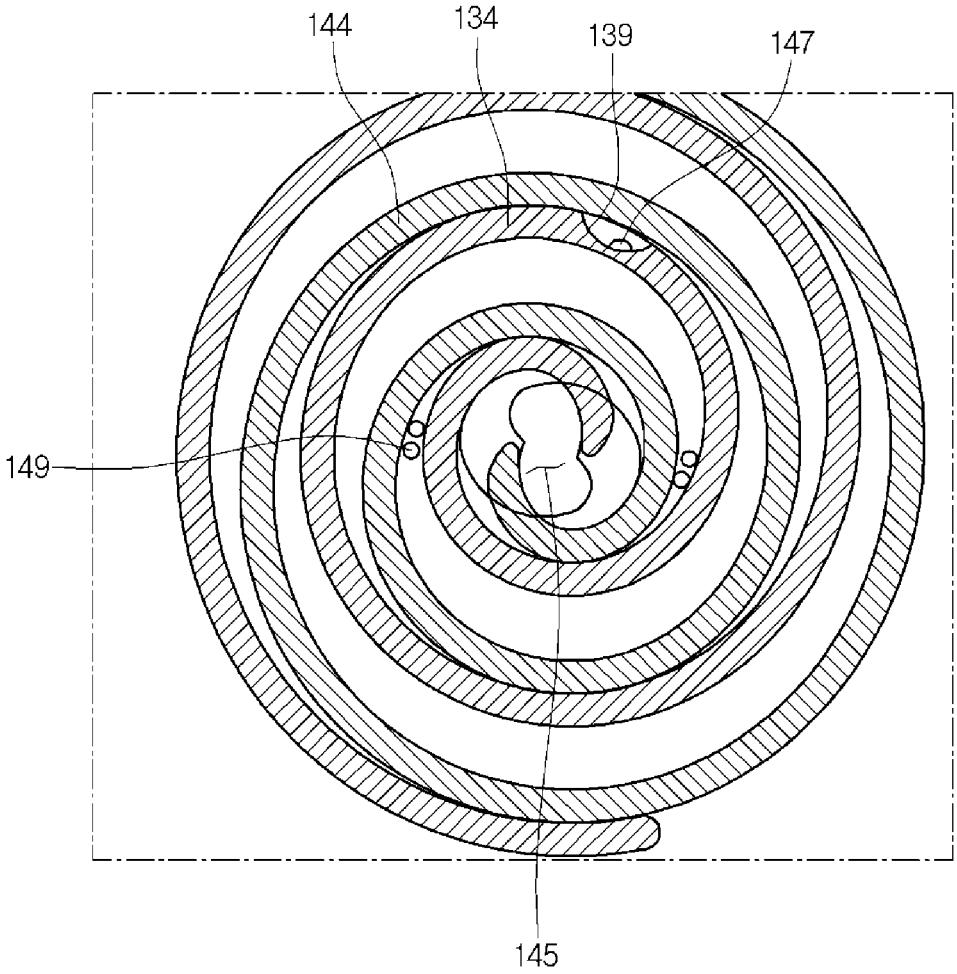
Figure 11C:
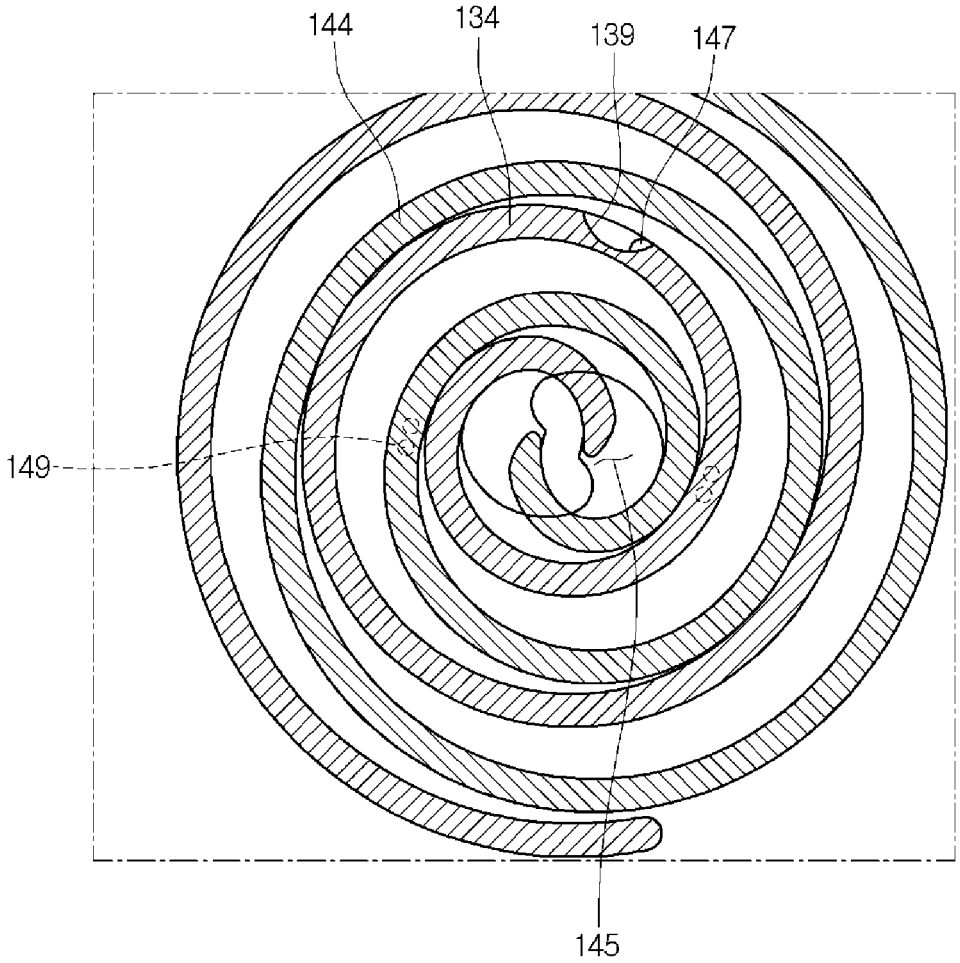
Figure 12A:
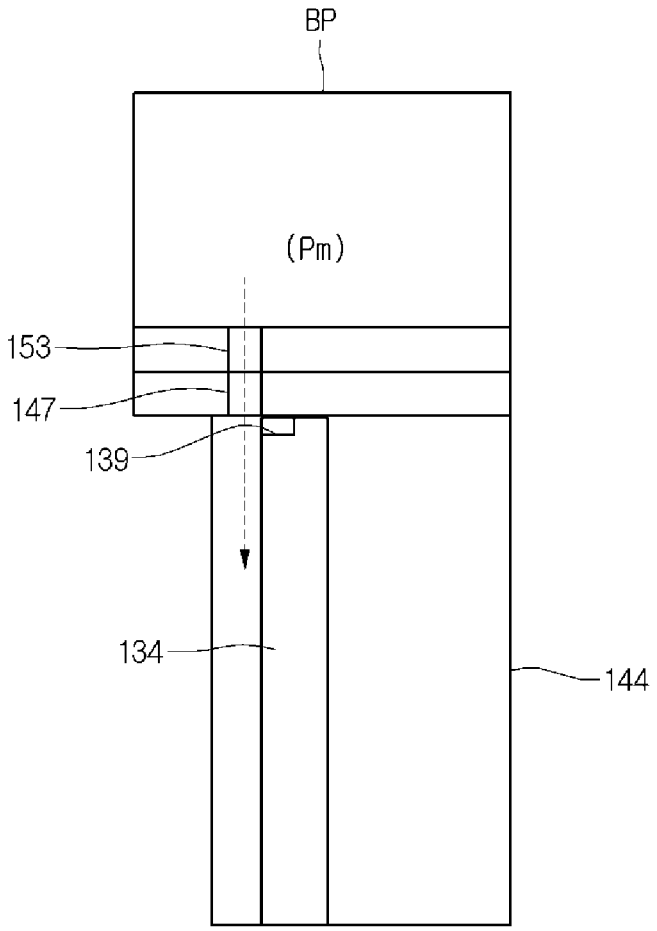
FIGS. 12A and 12B are schematic views of a state in which an intermediate pressure refrigerant of a back pressure chamber is discharged into the compression chamber through the discharge guide according to a position of the orbiting scroll.
Figure 12B:
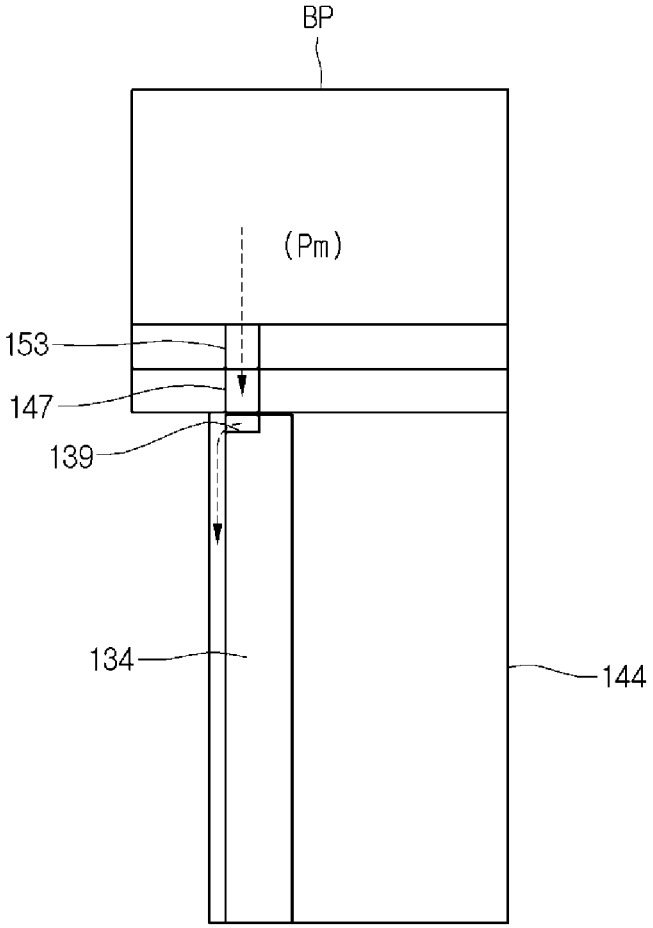

FIG. 9 is a partial view of an orbiting scroll according to an embodiment. FIG. 10 is a cross-sectional view illustrating a state in which the fixed scroll and the orbiting scroll are coupled to each other according to the first embodiment. FIGS. 11A to 11C are views illustrating relative positions of an intermediate pressure discharge hole of the fixed scroll and a discharge guide of the orbiting scroll while the orbiting scroll revolves. FIGS. 12A and 12B are schematic views of a state in which the intermediate pressure refrigerant of a back pressure chamber is discharged into the compression chamber through the discharge guide according to a position of the orbiting scroll.

Referring to FIGS. 9 and 10, the orbiting scroll 130 may include a discharge guide 139 to guide the refrigerant flowing into the intermediate pressure discharge hole 147 so that the refrigerant may be introduced into a space (region) having a pressure less than a pressure of the back pressure chamber BP. In detail, when operation of the scroll compressor 100 is stopped, the compression chamber defined by the orbiting wrap 134 and the fixed wrap 144 vanishes, and thus, the refrigerant flows into the space (region) between the orbiting wrap 134 and the fixed wrap 144. The space (region) may have a pressure less than a pressure of the back pressure chamber BP. The space (region) may be referred to as a "wrap space".

The discharge guide 139 may be recessed from an end surface of the orbiting wrap 134 of the orbiting scroll 130. Thus, the discharge guide 139 may be referred to as a "recess". The end surface of the orbiting wrap 134 may be understood as a surface of the orbiting wrap 134 that faces the fixed head plate 143 of the fixed scroll 140 or a surface of the orbiting wrap 134 that contacts the fixed head plate 143.

A width of the end surface of the orbiting wrap 134, that is, a thickness of the orbiting wrap 134 may be greater than a width of the intermediate pressure discharge hole 147. Also, the discharge guide 139 may be recessed from the end surface of the orbiting wrap 134 by a preset or predetermined width and depth.

While the orbiting scroll 130 revolves, the orbiting wrap 134 may be disposed directly below the intermediate pressure discharge hole 147 or be disposed to be spaced horizontally from a lower end of the intermediate pressure discharge hole 147 to open the intermediate pressure discharge hole 147. If the discharge guide 139 is not provided, when the orbiting wrap 134 is disposed directly below the intermediate pressure discharge hole 147 (in FIG. 10), the orbiting wrap 134 may cover the intermediate pressure discharge hole 147. On the other hand, when the orbiting wrap 134 moves horizontally by a predetermined distance, at least a portion of the intermediate pressure discharge hole 147 may be opened. Also, while the scroll compressor 100 operates, when the intermediate pressure discharge hole 147 is opened, the intermediate pressure refrigerant of the compression chamber may be introduced into the back pressure chamber BP through the intermediate pressure discharge hole 147.

On the other hand, in a state in which the scroll compressor 100 is stopped, when the orbiting wrap 134 is disposed directly below the intermediate pressure discharge hole 147 to block the intermediate pressure discharge hole 147, the refrigerant of the back pressure chamber BP may not be introduced into the wrap space through the intermediate pressure discharge hole 147. As a result, an equilibrium pressure may not be maintained, and thus, quick re-operation of the compressor may be limited.

Thus, according to this embodiment, the discharge guide 139 may be disposed in the orbiting wrap 134 to prevent the intermediate pressure discharge hole 147 from being completely covered or shielded, and thus, even though the orbiting wrap 134 is disposed directly below the intermediate pressure discharge hole 147, the intermediate pressure discharge hole 147 and the compression chamber (when the compressor operates) or the intermediate pressure discharge hole 147 and the wrap space (when the compressor stops) may communicate with each other.

Referring to FIGS. 11A to 11C, the plurality of compression chambers is formed while the orbiting scroll 130 revolves, and then, the plurality of compression chambers moves toward the discharge hole 145 while being reduced in volume. With this process, the orbiting wrap 134 of the orbiting scroll 130 may selectively open the bypass hole 149. For example, when the orbiting wrap 134 opens the bypass hole 149, the refrigerant of the compression chamber that communicates with the bypass hole 149 may flow into the bypass hole 149 to bypass the discharge hole 145. On the other hand, when the orbiting wrap 134 covers the bypass hole 149, flow of the refrigerant of the compression chamber into the bypass hole 149 may be limited.

The back pressure chamber BP and the intermediate pressure discharge hole 147 may always communicate with the compression chamber via the discharge guide 139. That is, the discharge guide 139 may be disposed on an end of the orbiting wrap 134 at a position at which the back pressure chamber BP and the intermediate pressure discharge hole 147 always communicate with the compression chamber.

In summary, even though the orbiting wrap 134 is disposed directly below the intermediate pressure discharge hole 147 while the orbiting wrap 134 revolves, the lower end of the intermediate pressure discharge hole 147 and the end surface of the orbiting wrap 134 may be spaced apart from each other by the recessed discharge guide 139. Thus, when the scroll compressor 100 operates, refrigerant of the compression chamber may be introduced into the back pressure chamber BP through the intermediate pressure discharge hole 147. Also, when the scroll compressor 100 is stopped, the refrigerant of the back pressure chamber BP may be introduced into the wrap space through the intermediate pressure discharge hole 147.

In detail, FIGS. 11A to 11C illustrate a state in which the orbiting wrap 134 is disposed directly below the intermediate pressure discharge hole 147 while the orbiting wrap 134 revolves, that is, the state in which the end surface of the orbiting wrap 134 is disposed to block the intermediate pressure discharge hole 147 if the discharge guide 139 is not provided.

Even though the orbiting wrap 134 is disposed as illustrated in FIGS. 11A to 11C, the intermediate pressure discharge hole 147 may communicate with the compression chamber by the discharge guide 139. Thus, as illustrated in FIG. 12B, the refrigerant of the back pressure chamber BP having an intermediate pressure Pm may be introduced into the wrap space between the orbiting wrap 134 and the fixed wrap 144 via the intermediate pressure discharge hole 147 and the discharge guide 139.

If the orbiting wrap 134 is disposed at a position that is not illustrated in FIGS. 11A to 11C, at least a portion of the intermediate pressure discharge hole 147 is opened. That is, the orbiting wrap 134 may be in a state in which the orbiting wrap 134 moves horizontally to open the at least a portion of a lower end of the intermediate pressure discharge hole 147. Thus, as illustrated in FIG. 12A, as the intermediate pressure discharge hole 147 is opened, the refrigerant of the back pressure chamber BP having the intermediate pressure Pm may be introduced into the wrap space through the intermediate pressure discharge hole 147.

Figure 13:
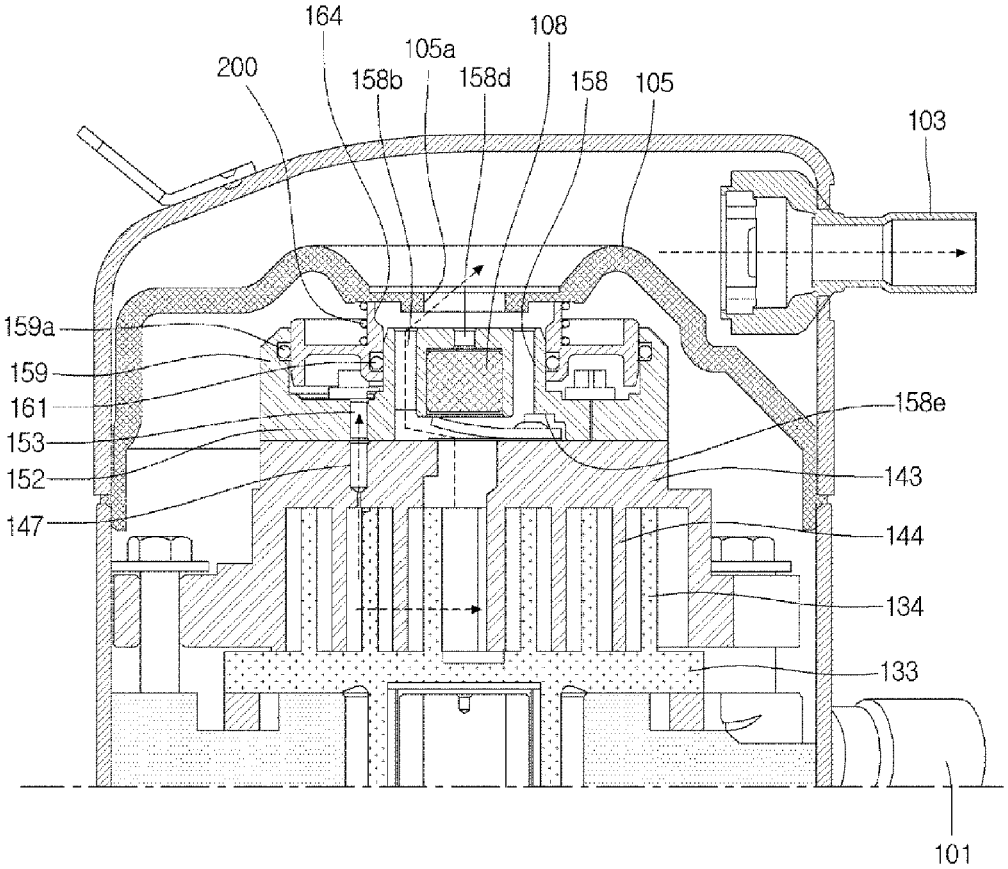
FIG. 13 is a cross-sectional view illustrating a flow of refrigerant when the scroll compressor operates according to an embodiment.
Figure 14:
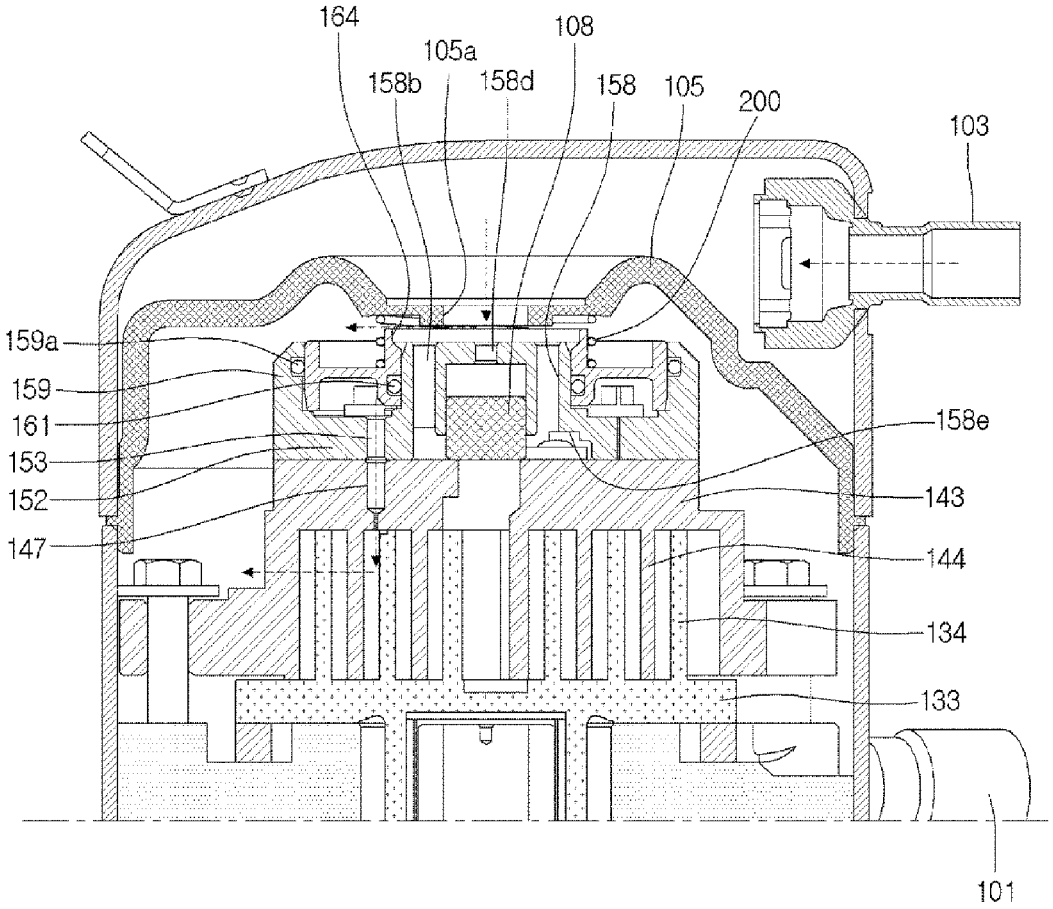
FIG. 14 is a cross-sectional view illustrating a flow of refrigerant when the scroll compressor stops according to an embodiment.

FIG. 13 is a cross-sectional view illustrating a flow of refrigerant when the scroll compressor operates according to an embodiment. FIG. 14 is a cross-sectional view illustrating a flow of refrigerant when the scroll compressor stops according to an embodiment.

Referring to FIGS. 13 and 14, when the scroll compressor operates or stops, effects according to this embodiment, that is, a flow of the refrigerant will be described hereinbelow. Referring to FIG. 13, in a case in which the scroll compressor 100 operates, when power is applied to the stator 112, the rotational shaft 116 is rotated by the stator 112 and the rotor 114. As the rotational shaft 116 rotates, the orbiting scroll 130 coupled to the rotational shaft 116 may revolve with respect to the fixed scroll 140. As a result, the plurality of compression chambers formed between the fixed wrap 144 and the orbiting wrap 134 may move toward the discharge hole 145 to compress the refrigerant.

The fixed wrap 144 and the orbiting wrap 134 may be closely attached to each other in a radial direction, that is, a direction perpendicular to the rotational shaft 116 to form the plurality of compression chambers. The plurality of compression chambers may be sealed by the closely attached operations of the wraps 134 and 144 to prevent the refrigerant from radially leaking.

While the refrigerant is compressed, at least a portion of the refrigerant within the compression chamber having the intermediate pressure may be introduced into the back pressure chamber BP through the intermediate pressure discharge hole 147 of the fixed scroll 140 and the intermediate pressure suction hole 153 of the back pressure plate 150. Even though the orbiting wrap 134 of the orbiting scroll 130 is disposed directly below the intermediate pressure discharge hole 147 to contact the intermediate pressure discharge hole 147, as the intermediate pressure discharge hole 147 and the compression chamber communicate with each other by the discharge guide 139, the refrigerant may flow into the intermediate pressure discharge hole 147. Also, as the intermediate pressure discharge hole 147 and the back pressure chamber BP communicate with each other, the refrigerant flowing through the intermediate pressure discharge hole 147 may be easily introduced into the back pressure chamber BP.

Thus, the back pressure chamber BP may have the intermediate pressure that corresponds between the suction pressure and the discharge pressure. The elastic force of the elastic member 200 may act on the floating plate 160 before the intermediate pressure is generated in the back pressure chamber BP and also act on the fixed scroll 140 through the floating plate 160 and the back pressure plate 150. Thus, when the scroll compressor 140 initially operates, ascending of the fixed scroll 140 due to the elastic force of the elastic member 200 may be minimized.

Also, as the back pressure chamber has the intermediate pressure, a downward force may be applied to the back pressure plate 150, and an upward force may be applied to the floating plate 160. The force to lift the floating plate 160 upward by the intermediate pressure of the back pressure chamber BP may be greater than the elastic force of the elastic member 200.

As the back pressure plate 150 is coupled to the fixed scroll 140, the intermediate pressure of the back pressure chamber BP may have an influence on the fixed scroll 140. However, as the fixed wrap 143 of the fixed scroll 140 is in contact with the orbiting head plate 133 of the orbiting scroll 130, the floating plate 160 may move upward.

As the floating plate 160 moves upward, the rib 164 of the floating plate 160 may move upward until the rib 164 contacts the bottom surface of the discharge cover 105. As the elastic force of the elastic member 200 acts on the floating plate 160 as the floating plate 160 moves upward, an impact noise between the rib 164 and the discharge cover 105 when the rib 164 contacts the discharge cover 105 may be reduced. That is, sudden collision of the rib 164 and the elastic member 200 may be prevented by the elastic member 200.

Also, the pressure of the back pressure chamber BP may compress the fixed scroll 140 toward the orbiting scroll 130 to prevent the refrigerant from leaking between the orbiting scroll 130 and the fixed scroll 140. The fixed wrap 144 and orbiting head plate 133 and the orbiting wrap 134 and the fixed head plate 143 may be closely attached to each other in an axial direction, that is, a direction parallel to the rotational shaft 116 to form the plurality of compression chambers. The plurality of compression chambers may be sealed by adhesion between the wraps 134 and 144 and the orbiting and fixed head plates 133 and 143 to prevent the refrigerant from leaking in the axial direction.

Also, the refrigerant of the compression chamber moving toward the discharge hole 145 may flow toward the intermediate discharge hole 158*b* of the back pressure plate 150 through the discharge hole 145, and then, may be discharged to the outside of the discharge port 103 via the discharge hole 105*a* of the discharge cover 105. The discharge valve 108 may be in a state in which the discharge valve 108 is moved upward along the moving guide 158*c* by the refrigerant having the discharge pressure, which may be discharged from the discharge hole 145. Thus, the discharge hole 145 may be opened. That is, as the pressure of the discharge hole 145 is greater than the pressure of the discharge space D, the discharge valve 108 may move upward.

As described above, as the rib 164 contacts the bottom surface of the discharge cover 105 to block the passage between the floating plate 160 and the discharge cover 105, refrigerant passing through the intermediate discharge hole 158*b* may not flow toward the suction space S through the passage to pass through the discharge hole 105*a* of the discharge cover 105. Although not shown, while the refrigerant is compressed in the plurality of compression chambers, the compression chamber that communicates with the bypass hole(s) 149 may have the intermediate pressure. As the intermediate pressure is less than the discharge pressure, the bypass hole(s) 149 may be in a closed state.

However, if the suction pressure increases due to changes in operation conditions, the intermediate pressure, which is greater by about 1.5 times than the suction pressure, may be greater than the discharge pressure. In a case of the scroll compressor, as a compression ratio is fixed, the discharge pressure may be obtained by multiplying the suction pressure by the compression ratio. Thus, if the suction pressure exceeds an optimal range, the discharge pressure may excessively increase, causing overload. Thus, even before the refrigerant of the compression chamber having the intermediate pressure reaches the discharge hole 145, if the intermediate pressure is excessive, the refrigerant has to be previously discharged to solve the overload.

In this embodiment, if the intermediate pressure increases greater than the discharge pressure, the valve(s) body 124*c* may ascend to allow the bypass valve 124 to open the bypass hole(s) 149. Also, the refrigerant within the compression chamber having the intermediate pressure chamber may flow into the discharge space D through the bypass hole(s) 149. The refrigerant discharged through the bypass hole(s) 149 may be mixed with the refrigerant discharged from the discharge hole 145 to flow into the discharge space D. Due to the above-described operation, excessive increase of the pressure of the compression chamber having the intermediate pressure chamber may be prevented.

In the case of the scroll compressor, as a range of operation conditions of a system to be adopted for the scroll compressor is preset or predetermined, ranges of suction and discharge pressures may be predetermined. Also, a time point at which the compression chamber having the intermediate pressure is excessive may be predicted on the basis of the above-described values. Thus, the bypass hole(s) may be formed at a position or positions corresponding to the time point to solve the overload.

In this embodiment, as the back pressure chamber assembly 150 and 160 is separable, the bypass hole(s) 149 may be defined in a predetermined position of the fixed head plate 143 of the fixed scroll 140, and then, the bypass valve(s) 124 may be disposed to effectively prevent overload from occurring.

Next, referring to FIG. 14, when the scroll compressor 100 is stopped, supply of power applied to the stator 112 may be stopped. Thus, rotation of the rotational shaft 116 and revolution of the orbiting scroll 130 may be stopped, stopping a compression operation of the refrigerant. When the compression operation of the refrigerant is stopped, a force to closely attach the fixed wrap 114 to the orbiting wrap 134, that is, a force to closely attach the fixed wrap 114 to the orbiting wrap 134 in the radial direction may be relieved or released. Thus, the sealed compression chamber formed by the fixed wrap 144 and the orbiting wrap 134 may vanish.

In detail, the discharge hole-side refrigerant having a relatively high pressure and the refrigerant within the compression chamber may flow toward the suction space S. A pressure of the wrap space formed by the fixed wrap 144 and the orbiting wrap 134 may converge to a predetermined pressure (equilibrium pressure). Also, as the pressure of the discharge space D temporarily increases, the discharge valve 108 may move downward to block the discharge hole 145. Thus, it may prevent the refrigerant of the discharge space D from flowing backward to the wrap space through the intermediate discharge hole 158*b* and the discharge hole 145 and reversing the fixed scroll 140.

As the scroll compressor 100 is stopped, the orbiting wrap 134 may be stopped at a predetermined position. Even though the orbiting wrap 134 is disposed at a position at which the intermediate pressure discharge hole 147 is opened (see FIG. 12A), as well as, the orbiting wrap 134 is disposed at a position at which the intermediate pressure discharge hole 147 is closed (see FIG. 12B), refrigerant of the back pressure chamber BP may be bypassed to the wrap space through the discharge guide 139.

That is, the refrigerant of the back pressure chamber BP may be introduced into the wrap space through the intermediate pressure suction hole 153 and the intermediate pressure discharge hole 147 to flow into the suction space S. Also, the back pressure chamber BP may be maintained at the equilibrium pressure by the flow of the refrigerant.

As the back pressure chamber BP is maintained at the equilibrium pressure, the floating plate 160 may smoothly move downward by the elastic force of the elastic member 200, and thus, the rib 164 may be spaced apart from the bottom surface of the discharge cover 105. Thus, the passage between the floating plate 160 and the discharge cover 105 may be opened. As a result, the refrigerant of the discharge cover 105 or the discharge space D may flow toward the suction space S through the passage. The pressure of the discharge cover 105 or the discharge space D may be maintained at the equilibrium pressure by the flow of the refrigerant.

As described above, as the refrigerant of the back pressure chamber BP is introduced into the wrap space through the discharge guide 139 of the orbiting wrap 134, the back pressure chamber BP may be maintained at the equilibrium pressure. Also, the rib 164 may be spaced apart from the discharge cover 105 to open the passage of the refrigerant. As a result, as the pressure of the discharge cover 105 or the discharge space D is maintained at the equilibrium pressure, the scroll compressor 100 may quickly re-operate when the scroll compressor 100 is re-started.

If the refrigerant of the back pressure chamber BP is not introduced into the wrap space to allow the back pressure chamber BP to be maintained to the intermediate pressure, and also, the rib 164 is maintained in contact with the discharge cover 105, and thus, the pressure of the discharge cover 105 and the discharge space D is not maintained at the equilibrium pressure, the fixed scroll 140 and the orbiting scroll 130 may be closely attached to each other at an excessive pressure. As a result, it may be difficult to quickly drive the scroll compressor 100 again. However, this embodiment may solve the above-described limitation.

Also, even though the refrigerant of the back pressure chamber BP smoothly flows into the wrap space, if the rib 164 of the floating plate 160 is not quickly spaced apart from the discharge cover 105, it may be difficult to quickly re-operate the scroll compressor 100. In the case of this embodiment, as the elastic force of the elastic member 200 is applied to the floating plate 160, the rib 164 of the floating plate 160 may be quickly spaced apart from the discharge cover 105.

Also, a check valve (not shown) may be disposed in the discharge port 103. Thus, when operation of the scroll compressor 100 is stopped, the check valve may be closed to prevent the refrigerant outside of the scroll compressor 100 from being introduced into the casing 110 through the discharge port 103.

Figure 15:
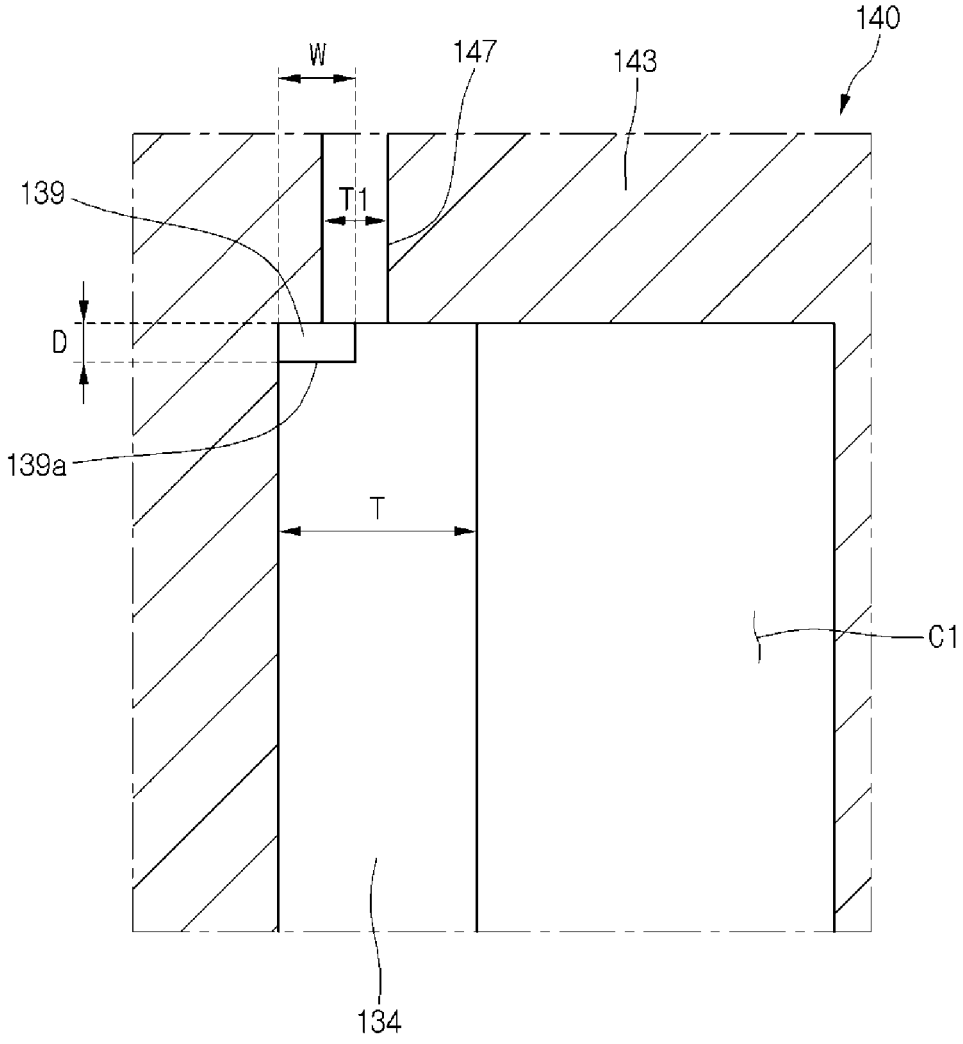
FIG. 15 is a cross-sectional view illustrating a discharge guide of the orbiting scroll according to an embodiment.
Figure 16A:
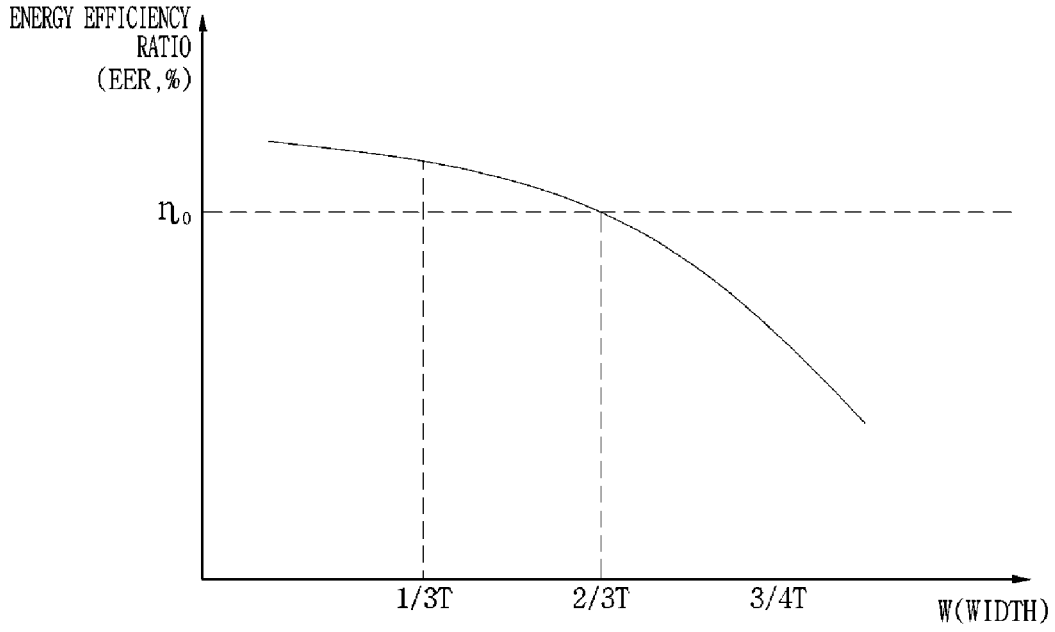
FIGS. 16A and 16B are graphs illustrating a variation in efficiency of the scroll compressor according to a size of the discharge guide.
Figure 16B:
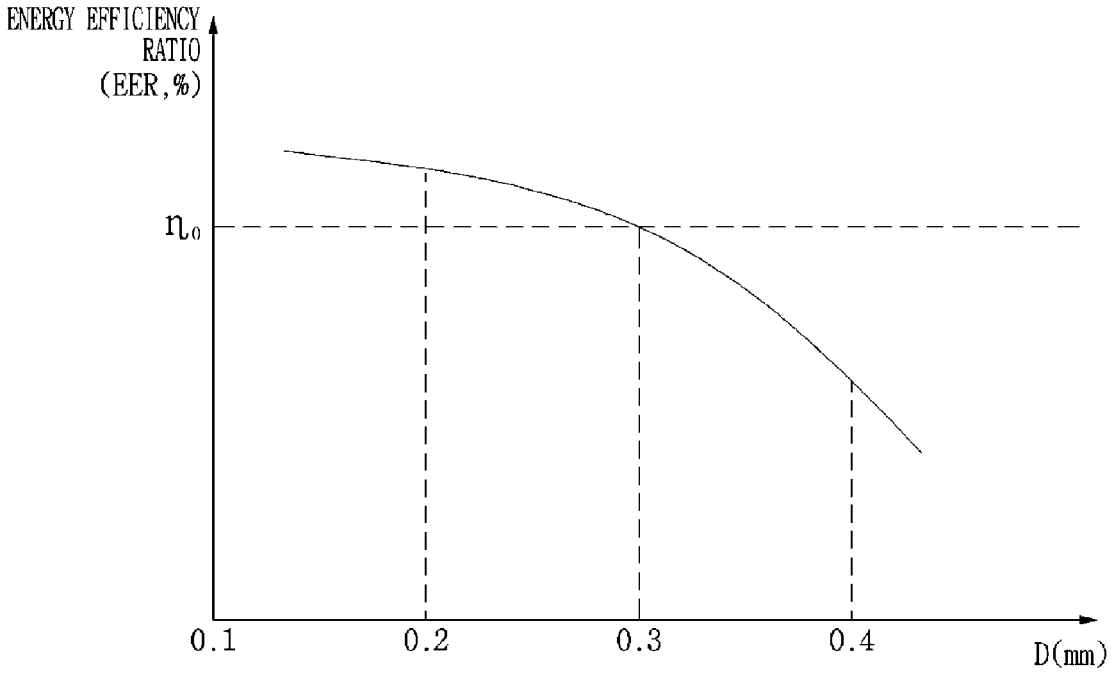

FIG. 15 is a cross-sectional view illustrating a discharge guide of the orbiting scroll according to an embodiment. FIGS. 16A and 16B are graphs illustrating a variation in efficiency of the compressor according to a size of the discharge guide.

Referring to FIG. 15, in the orbiting wrap 134, the discharge guide 139 to open the intermediate pressure discharge hole 147 and guide the refrigerant so that the refrigerant is discharged from the intermediate pressure discharge hole 147 to a wrap space C1 may be defined to have a preset or predetermined width W and depth D. The width W may refer to a length in a radial direction of the discharge guide 139, and the depth D may refer as a distance from an end of the intermediate pressure discharge hole 147 to a recessed surface 139*a* of the discharge guide 139.

The wrap space C1 may refer to a space between the orbiting wrap 134 and the fixed wrap 144 in a state in which the compression chamber formed by closely attaching the orbiting wrap 134 to the fixed wrap 144 vanishes after the scroll compressor 100 stops. Also, the orbiting wrap 134 may have a thickness T greater than a size or thickness T1 of the intermediate pressure discharge hole 147. The size or thickness T1 of the intermediate pressure discharge hole 147 may be a diameter when the intermediate pressure discharge hole 147 has a circular cross-section. When the intermediate pressure discharge hole 147 has an oval or polygonal shape, the size or thickness T1 of the intermediate pressure discharge hole 147 may be a largest width defined in a horizontal (radial) direction.

The discharge guide 139 may have the recessed surface 139*a* formed by being recessed to have the width W and depth D. A horizontal length of the recessed surface 139*a* may correspond to the width W, and a vertical length of the recessed surface 139*a* may correspond to the depth D.

Although the recessed surface 139*a* is bent in a horizontal or vertical direction in FIG. 15, embodiments are not limited thereto. For example, the recessed surface 139*a* may include a curved portion or have a straight-line shape without being bent.

If the discharge guide 139 has a too large width W or depth D, the refrigerant may leak from the compression chamber having a relatively high pressure to the compression chamber having a relatively low pressure among the plurality of compression chambers when the scroll compressor 100 operates, and thus, the scroll compressor 100 may be deteriorated in operation efficiency. Thus, this embodiment proposes a dimension with respect to the width W or depth D of the discharge guide 139 to allow the refrigerant to smoothly flow from the back pressure chamber BP to the wrap space C1 without deteriorating the operation efficiency of the compressor. FIGS. 16A-16B illustrate graphs obtained by repetitive experiments.

Referring to FIG. 16A, a horizontal axis of the graph represents a width W of the discharge guide 139, and a vertical axis represents an energy efficiency ratio (EER) of the scroll compressor. The discharge guide 139 may have a depth D corresponding to a preset or predetermined value (constant value).

In detail, the more the width W of the discharge guide 139 increases, the more a leaking amount of refrigerant while the refrigerant is compressed, that is, a refrigerant leaking amount in an axial direction increases. Thus, the EER of the scroll compressor may be reduced.

Also, to maintain the EER of the scroll compressor 100 to a value greater than a required efficiency ratio ηo, the discharge guide 139 may have a width W less than about 2T/3. When the width W of the discharge guide 139 is less than about 2T/3, for example, is 3T/4, it may be seen that the EER of the scroll compressor 100 is reduced by about 30% or more in comparison with the required efficiency ratio ηo.

Next, referring to FIG. 16B, a horizontal axis of the graph represents a depth D of the discharge guide 139, and a vertical axis represents the energy efficiency ratio (EER) of the scroll compressor. The discharge guide 139 may have a width W corresponding to a preset or predetermined value (constant value).

In detail, the more the depth D of the discharge guide 139 increases, the more a leaking amount of refrigerant while the refrigerant is compressed, that is, a refrigerant leaking amount in a radial direction increases. Thus, the EER of the scroll compressor 100 may be reduced.

Also, to maintain the EER of the scroll compressor 100 to a value greater than a required efficiency ratio ηo, the discharge guide 139 may have a depth D less than about 0.3 mm. When the depth D of the discharge guide 139 is less than about 0.3 mm, for example, is about 0.4 mm, it may be seen that the EER of the scroll compressor is reduced by about 30% or more in comparison with the required efficiency ratio ηo.

In summary, the discharge guide 139 may have a depth D of about 0.3 mm or less. Also, the discharge guide 139 may have a width W less by about ⅔ times than the thickness T of the orbiting wrap 134.

Figure 17:
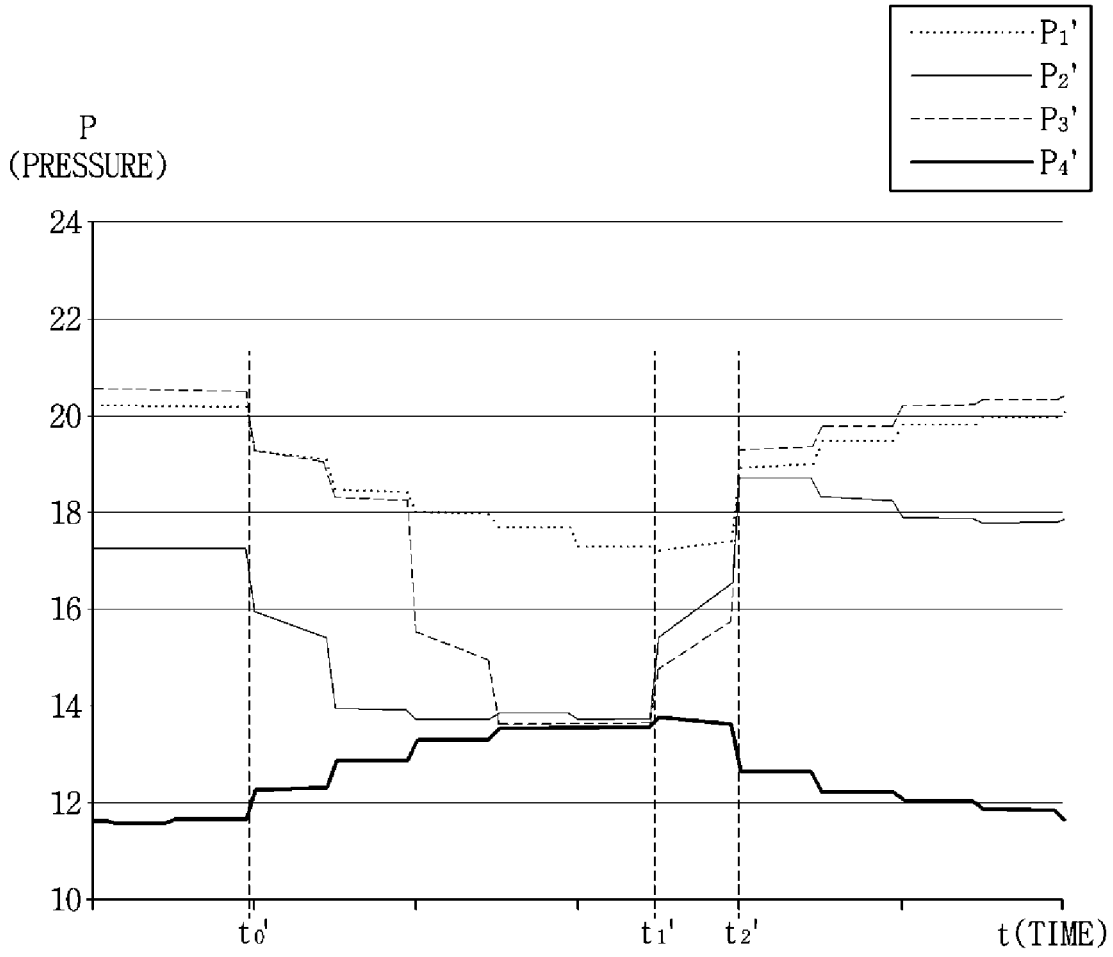
FIG. 17 is a graph illustrating a variation in inner pressure of the scroll compressor when the scroll compressor stops and then re-operates according to an embodiment.

FIG. 17 is a graph illustrating a variation in inner pressure of the scroll compressor when the scroll compressor stops and then re-operates according to an embodiment. Referring to FIG. 17, when the scroll compressor 100 is stopped at a time $t_0'$, each of $P_1'$ (a pressure of the refrigerant discharged from the scroll compressor), $P_2'$ (an intermediate pressure of the back pressure chamber), $P_3'$ (a pressure of the discharge cover-side refrigerant), and $P_4'$ (a pressure of the suction-side refrigerant) may gradually converge to an equilibrium pressure.

Also, when a power is applied to the stator 112 at a time $t_1'$ to allow operation of the scroll compressor to start, the scroll compressor may re-operate at a time $t_2'$ after a short time Δt elapses. As a result, a difference in pressure for each position within the scroll compressor may occur. That is, actual compression of the refrigerant may be quickly performed.

Figure 18:
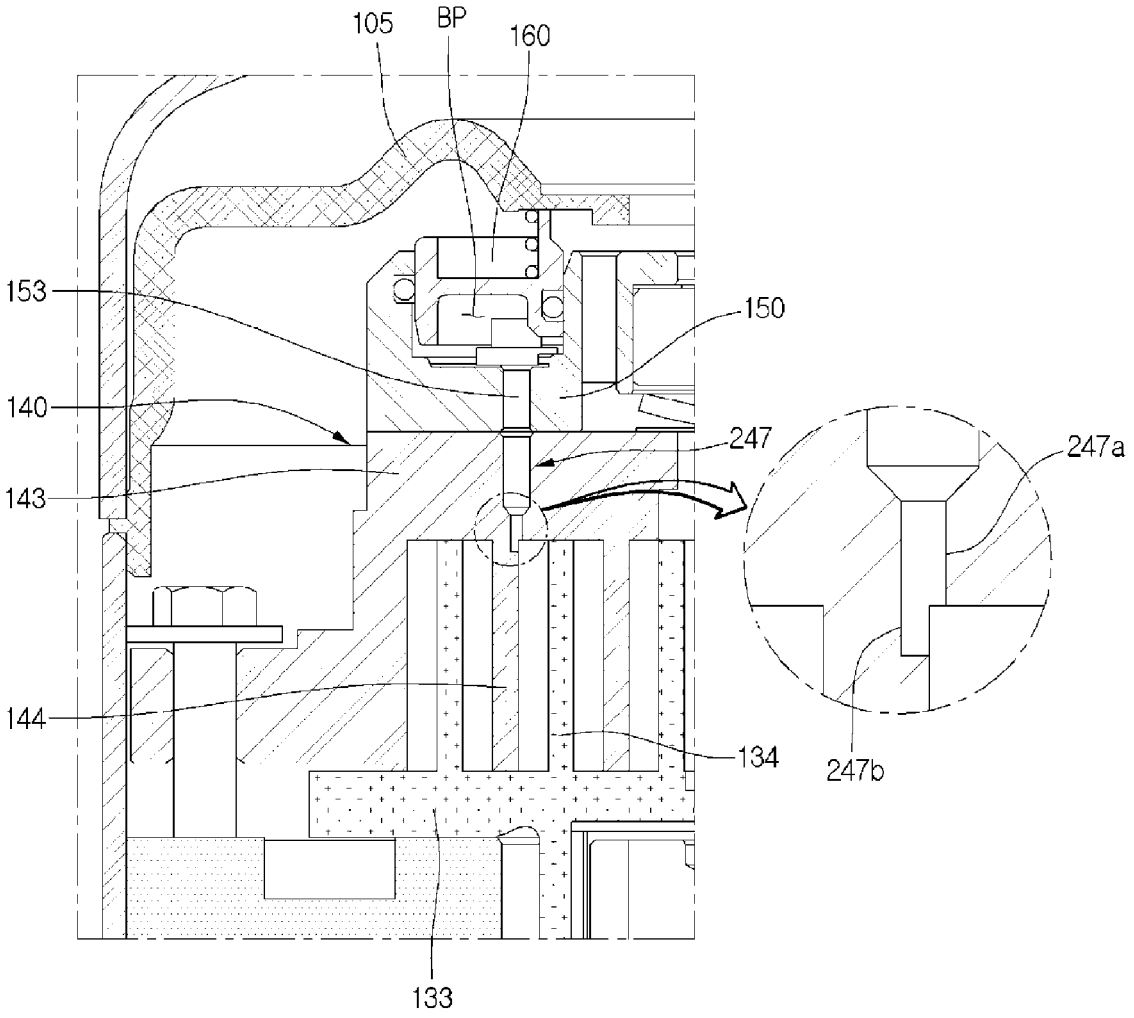
FIG. 18 is a partial cross-sectional view of a scroll compressor according to another embodiment.

FIG. 18 is a partial cross-sectional view of a scroll compressor according to another embodiment. Referring to FIG. 18, scroll compressor 100 according to this embodiment may include an intermediate pressure discharge hole 247 defined in fixed scroll 140 to define a discharge guide to guide a flow of a refrigerant into a compression chamber. In detail, the intermediate pressure discharge hole 247 may include a first guide 247*a* defined in fixed head plate 143 of fixed scroll 140, and a second guide 247*b* defined in fixed wrap 144 of fixed scroll 140. Each of the first and second guides 247*a* and 247*b* may form at least a portion of the intermediate pressure discharge hole 247.

Unlike that the intermediate discharge hole 147 according to the previous embodiment which is defined in the fixed head plate 143 of the fixed scroll 140, the intermediate pressure discharge hole 247 according to this embodiment may extend from the fixed head plate 143 of the fixed scroll 140 into the fixed wrap 144. That is, the intermediate pressure discharge hole 247 may be defined in the fixed wrap 144.

As a result, as the intermediate pressure hole 247 may function as a "discharge guide" and may be defined in the fixed head plate 143 and extend into the fixed wrap 144, that is, as an opened portion of the intermediate pressure discharge hole 247 extends in an "axial direction" parallel to rotational shaft 116 and a "radial direction" perpendicular to the axial direction, the intermediate pressure discharge hole 247 may easily communicate with the compression chamber.

More particularly, in a state in which the scroll compressor 100 stops, adhesion between the fixed scroll 140 and the orbiting scroll 130 in the radial direction may be weakened to form a wrap space between the orbiting wrap 134 and the fixed wrap 144. Thus, the refrigerant may be easily discharged from the intermediate pressure discharge hole 247.

In summary, as the discharge guide according to this embodiment is defined in the intermediate pressure discharge hole 247, when the scroll compressor 100 stops, back pressure chamber BP may communicate with the wrap space regardless of a position of the orbiting wrap 134. Thus, the scroll compressor may quickly re-operate.

Further, while the scroll compressor 100 operates to compress the refrigerant, the intermediate pressure discharge hole 247 may communicate with the compression chamber through the first and second guides 247*a* and 247*b* regardless of a position of the orbiting wrap 134. Thus, the refrigerant of the compression chamber may be easily bypassed to the back pressure chamber BP via the intermediate pressure discharge hole 247.

Figure 19:
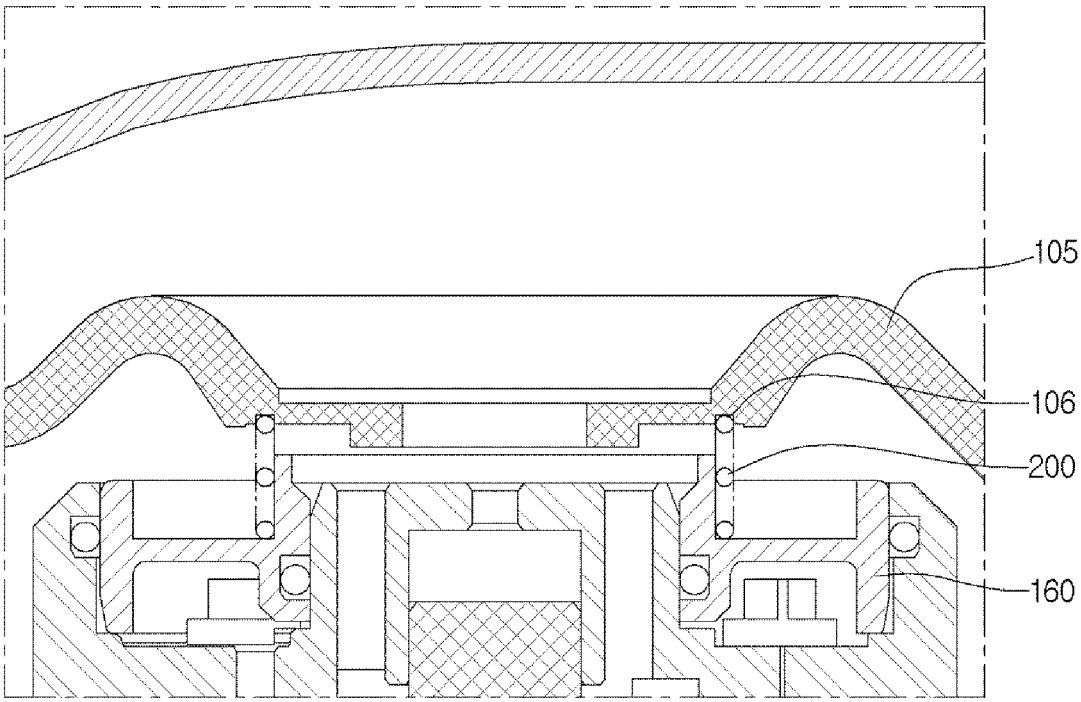
FIG. 19 is a partial cross-sectional view of a scroll compressor according to still another embodiment.

FIG. 19 is a partial cross-sectional view of a scroll compressor according to still another embodiment. This embodiment may be the same as the previous embodiments except for a structure of a discharge cover. Thus, only characterized parts in this embodiment will be described hereinbelow, and repetitive disclosure has been omitted.

Referring to FIG. 19, an elastic member accommodation portion 106 to accommodate an upper end of elastic member 200 may be defined in discharge cover 105 according to this embodiment. Thus, as the scroll compressor 100 operates to allow floating plate 160 to ascend by an intermediate pressure of back pressure chamber BP, even though the elastic member 200 is contracted, the upper end of the elastic member 200 may be accommodated in the elastic member accommodation portion 106 to prevent the elastic member 200 from horizontally moving while the elastic member 200 is contacted.

Also, when the scroll compressor 100 is stopped, as horizontal movement of the elastic member 200 is prevented while an elastic force of the elastic member 200 is transmitted to the floating plate 160, the elastic force of the elastic member 200 may be uniformly transmitted to the floating plate 160. Thus, the floating plate 160 may stably move toward fixed scroll 140.

Figure 20:
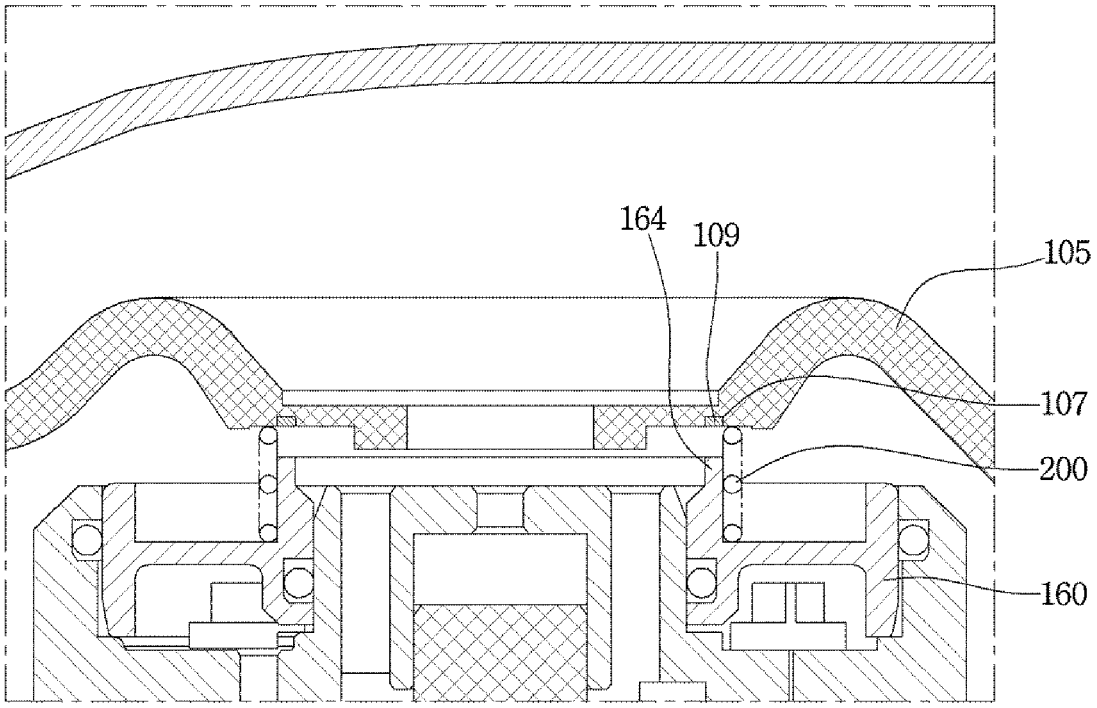
FIG. 20 is a partial cross-sectional view of a scroll compressor according to still another embodiment.

FIG. 20 is a partial cross-sectional view of a scroll compressor according to still another embodiment. This embodiment is the same as the previous embodiments, except for a structure of a discharge cover. Thus, only characterized parts in this embodiment will be described hereinbelow, and repetitive disclosure has been omitted.

Referring to FIG. 20, an impact absorption portion 109 may be disposed on a portion of discharge cover 105 according to this embodiment, which may face rib 164 of floating plate 160. A groove 107 to accommodate the impact absorption portion 109 may be defined in the discharge cover 105. For example, the impact absorption portion 109 may be formed of a rubber material or Teflon; however, embodiments are not limited thereto.

When the scroll compressor 100 operates to allow the floating plate 160 to ascend by an intermediate pressure of back pressure chamber BP, the rib 164 of the floating plate 160 may contact the impact absorption portion 109. As each of the rib 164 and the discharge cover 105 is formed of a metal material, when the rib 164 directly collides with the discharge cover 105, scratches occur on each of the rib 164 and the discharge cover 105, or each of the rib 164 and the discharge cover 105 may be deformed. In this case, a gap may be generated between the rib 164 and the discharge cover 105. Also, as the rib 164 directly collides with the discharge cover 105, noise may occur.

However, according to this embodiment, as the rib 164 does not directly collide with the discharge cover 105, but rather, collides with the impact absorption portion 109, occurrence of noise may be reduced, and generation of the gap due to damage to the discharge cover 105 or the rib 164 may be prevented.

Alternatively, the rib 164 may be directly accommodated in the groove 107. In this case, the rib 164 or the groove 107 may be damaged. However, generation of the gap between the discharge cover 105 and the rib 164 may be prevented unless the rib 164 is damaged by a depth of the groove 107.

Figure 21:
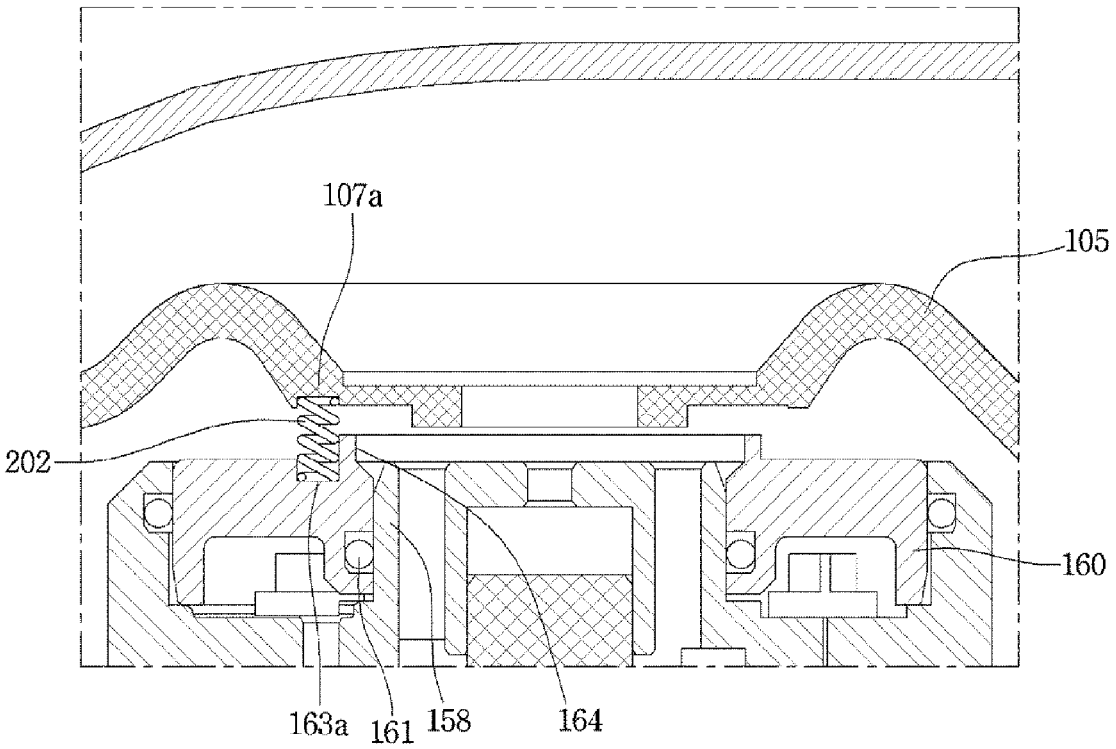
FIG. 21 is a partial cross-sectional view of a scroll compressor according to still another embodiment.

FIG. 21 is a partial cross-sectional view of a scroll compressor according to still another embodiment. This embodiment is the same as the previous embodiments except for an elastic member. Thus, only characterized parts in this embodiment will be described hereinbelow, and repetitive disclosure has been omitted.

Referring to FIG. 21, scroll compressor 100 according to this embodiment may include an elastic member 202 between discharge cover 105 and floating plate 160. For example, the elastic member 202 may be a compression coil spring. Also, the elastic member 202 may provide an elastic force to only a predetermined region of the floating plate 160. That is, the elastic member 202 may be disposed on or at one side of a rib 164 of the floating plate 160.

The discharge cover 105 may include a first accommodation portion 107*a*, in which a first end of the elastic member 202 may be accommodated, and the floating plate 160 may include a second accommodation portion 163*a*, in which a second end of the elastic member 202 may be accommodated. Second O-ring 161 disposed on the floating plate 160 may have a circular ring shape. Thus, a friction force between the second O-ring 161 and first wall 158 of back pressure plate 150 may be provided to an entire circumference of the first wall 158.

However, when the scroll compressor 100 is stopped, as an elastic force of the elastic member 202 may be applied to only a predetermined region of the floating plate 160, the floating plate 160 may be tilted toward the portion thereof to which the elastic force of the elastic member 202 is applied. Thus, as the friction force with the second O-ring 161 is removed or reduced in the predetermined region of the first wall 158, the floating plate 160 may quickly move toward fixed scroll 140 when compared to a case in which the elastic member 202 is not provided.

Figure 22:
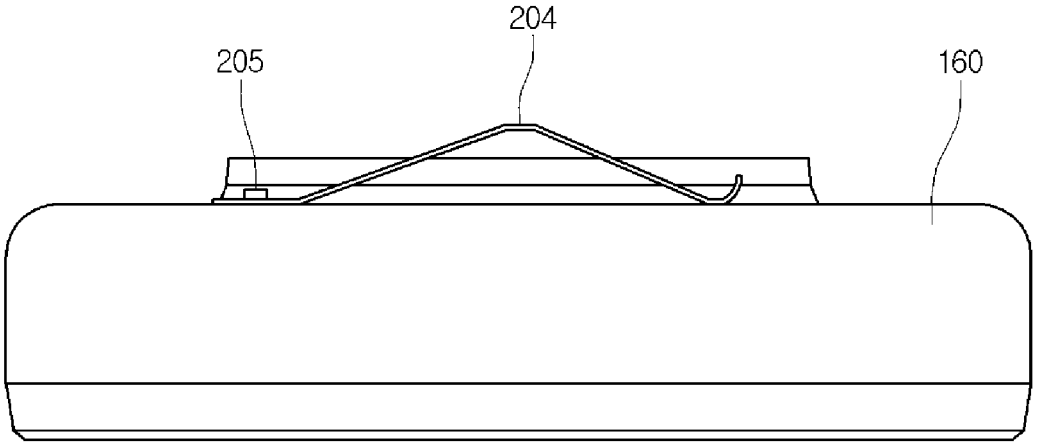
FIG. 22 is a partial cross-sectional view of a scroll compressor according to still another embodiment.

FIG. 22 is a partial cross-sectional view of a scroll compressor according to still another embodiment. This embodiment is the same as the previous embodiments except for an elastic member. Thus, only characterized parts in this embodiment will be described hereinbelow, and repetitive disclosure has been omitted.

Referring to FIG. 22, scroll compressor 100 according to this embodiment may include an elastic member 204 between discharge cover 105 and floating plate 160. For example, the elastic member 204 may be a leaf spring. Also, the elastic member 204 may have one end coupled to the floating plate 160 by a coupling member 205. Also, the elastic member 204 may contact the discharge cover 105. The leaf spring may also provide an elastic force to the floating plate 160 so the floating plate 160 may move in a direction away from the discharge cover 105. As another example, the elastic member 204 may be coupled to the discharge cover 105.

Although features for each embodiment are described above, the scope may include an embodiment derived from a combination of two or more embodiments as well as each of the embodiments.

Embodiment disclosed herein provide a scroll compressor.

Embodiments disclosed herein provide a scroll compressor that may include a casing including a rotational shaft; a discharge cover fixed inside of the casing to partition the inside of the casing into a suction space and a discharge space; a first scroll revolving by rotation of the rotational shaft; a second scroll that defines a plurality of compression chambers together with the first scroll, the second scroll having an intermediate pressure discharge hole that communicates with a compression chamber having an intermediate pressure of the plurality of compression chambers; a back pressure plate that defines a back pressure chamber that accommodates a refrigerant discharged from the intermediate pressure discharge hole; a floating plate movably disposed on a side of the back pressure plate to define the back pressure chamber together with the back pressure plate; and an elastic member disposed between the floating plate and the discharge cover to provide an elastic force to the floating plate.

Embodiments disclosed herein further provide a scroll compressor that may include a casing including a rotational shaft; a discharge cover fixed inside of the casing to partition the inside of the casing into a suction space and a discharge space; a first scroll that includes a first wrap revolving by rotation of the rotational shaft; a second scroll that includes a second wrap that defines a plurality of compression chambers together with the first wrap, the second scroll having an intermediate pressure discharge hole that communicates with a compression chamber having an intermediate pressure of the plurality of compression chambers; a back pressure plate that defines a back pressure chamber that accommodates a refrigerant discharged from the intermediate pressure discharge hole; a floating plate movably disposed on a side of the back pressure plate to define the back pressure chamber together with the back pressure plate; and an elastic member that provides an elastic force to press the second scroll to reduce an occurrence of a gap between an end of the first wrap and the second scroll while the refrigerant is compressed.

Embodiments disclosed herein further provide a scroll compressor that include a casing including a rotational shaft; a discharge cover fixed inside of the casing to partition the inside of the casing into a suction space and a discharge space; a first scroll revolving by rotation of the rotational shaft; a second scroll that defines a plurality of compression chambers together with the first scroll, the second scroll having an intermediate pressure discharge hole that communicates with a compression chamber having an intermediate pressure of the plurality of compression chambers; a back pressure plate that defines a back pressure chamber that accommodates a refrigerant discharged from the intermediate pressure discharge hole; a floating plate movably disposed on a side of the back pressure plate to define the back pressure chamber together with the back pressure plate, the floating plate including a rib that contacts the discharge cover; and an elastic member that provides an elastic force, which may move the floating plate in a direction away from the discharge cover, to the floating plate to reduce noise generated when the rib of the floating plate collides with the discharge cover while the refrigerant is compressed.

The details of one or more embodiments are set forth in the accompanying drawings and the description. Other features will be apparent from the description and drawings, and from the claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing comprising a rotational shaft;

a discharge cover fixed inside of the casing to partition the inside of the casing into a suction space and a discharge space;

a first scroll that is revolved by rotation of the rotational shaft;

a second scroll that defines a plurality of compression chambers together with the first scroll, the second scroll having an intermediate pressure discharge hole that communicates with a compression chamber having an intermediate pressure of the plurality of compression clambers;

a back pressure plate that defines a back pressure chamber that accommodates a refrigerant discharged from the intermediate pressure discharge hole;

a floating plate movably disposed on or at a side of the back pressure plate to define the back pressure chamber together with the back pressure plate; and an elastic member disposed between the floating plate and the discharge cover to provide an elastic force to the floating plate, wherein the floating plate comprises a rib that protrudes toward the discharge cover and contacts the discharge cover while the refrigerant is compressed, and wherein the elastic member is disposed to surround a circumference of the rib.

2. The scroll compressor according to claim 1, wherein the elastic member provides the elastic force to the floating plate so that the floating plate moves in a direction away from the discharge cover.

3. The scroll compressor according to claim 2, wherein the elastic member comprises a compression coil spring.

4. The scroll compressor according to claim 3, wherein an accommodation portion that accommodates the compression coil spring is disposed in at least one of the floating plate or the discharge cover.

5. The scroll compressor according to claim 2, wherein an elastic member accommodation portion that accommodates the elastic member is disposed in at least one of the floating plate or the discharge cover.

6. The scroll compressor according to claim 2, wherein the elastic member comprises a leaf spring coupled to one of the floating plate or the discharge cover.

7. The scroll compressor according to claim 6, wherein the elastic member is disposed at a side of the rib to provide the elastic force to only a predetermined region of the floating plate.

8. The scroll compressor according to claim 1, wherein the discharge cover comprises a groove in which the rib is accommodated.

9. The scroll compressor according to claim 1, wherein an impact absorption portion that contacts the rib is disposed on the discharge cover.

10. The scroll compressor according to claim 1, wherein a discharge guide that guides discharge of the refrigerant within the back pressure chamber is disposed on at least one of the first or the second scroll.

11. The scroll compressor according to claim 1, wherein the first scroll comprises an orbiting scroll, and the second scroll comprises a fixed scroll.

12. The scroll compressor according to claim 1, further comprising:

a main frame coupled to the second scroll; and at least one coupling member to couple the second scroll to the main frame, wherein at least on coupling guide to couple the at least one coupling member is disposed on the second scroll, and wherein the at least one coupling guide is spaced apart from the at least one coupling member in a state in which the at least one coupling member passes through the at least one coupling guide and is coupled to the main frame.

13. The scroll compressor according to claim 1, wherein the back pressure plate includes:

a support fixed to an upper portion of the second scroll;

an intermediate pressure suction hole that passes through the support and communicates with the intermediate pressure discharge hole of the second scroll;

a first wall that extends in an upward direction from an inner circumferential surface of the support; and a second wall that extends in the upward direction from an outer circumferential surface of the support.

14. The scroll compressor according to claim 13, wherein the first wall includes a top surface, and wherein at least one intermediate discharge hole is formed in the top surface that communicates with a discharge hole of the second scroll to discharge the refrigerant discharged from the discharge hole toward the discharge cover.

15. The scroll compressor according to claim 13, wherein the back pressure chamber is formed by the first wall, the second wall, the support, and the floating plate, wherein the floating plate is accommodated in the back pressure chamber to cover an upper portion of the back pressure chamber.

16. The scroll compressor according to claim 15, wherein an inner circumferential surface of the floating plate contacts an outer circumferential surface of the first wall, and an outer circumferential surface of the floating plate contacts an inner circumferential surface of the second wall.

17. The scroll compressor according to claim 16, wherein a first sealing member and a second sealing member that prevent the refrigerant within the hack pressure chamber from leaking are provided on the first wall, the second wall, and the floating plate, respectively.

18. The scroll compressor according to claim 17, wherein the first sealing member includes a first O-ring provided between the outer circumferential surface of the first wall and the inner circumferential surface of the floating plate, and wherein the second sealing member includes a second O-ring provided between the inner circumferential surface of the second wall and the outer circumferential surface of the floating plate.

19. The scroll compressor according to claim 16, wherein the rib is provided on a top surface of the floating plate, and wherein the rib extends toward the discharge cover from the inner circumferential surface of the floating plate.

20. The scroll compressor according to claim 13, wherein the back pressure plate has an approximately annular shape, and wherein the first wall and the second wall have an approximately cylindrical shape.

* * * * *